US005147754A

United States Patent [19]

Okamura et al.

[11] Patent Number: 5,147,754

[45] Date of Patent: * Sep. 15, 1992

[54] SILVER HALIDE PHOTOGRAPHIC MATERIAL

[75] Inventors: Hisashi Okamura; Hisashi Okada; Morio Yagihara; Kazunobu Katoh, all of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 742,070

[22] Filed: Aug. 7, 1991

Related U.S. Application Data

[63] Continuation of Ser. No. 511,165, Apr. 19, 1990, abandoned.

[30] Foreign Application Priority Data

Apr. 21, 1989 [JP] Japan ..... 1-102394

[51] Int. Cl.[5] ..... G03C 1/06

[52] U.S. Cl. ..... 430/264; 430/544; 430/547; 430/566; 430/596; 430/597; 430/598; 430/940; 430/957

[58] Field of Search ..... 430/222, 223, 264, 572, 430/566, 598, 957, 544, 546, 940, 596, 597, 547

[56] References Cited

U.S. PATENT DOCUMENTS 4,684,604 8/1987 Harder ..... 430/375
4,857,440 8/1989 Begley et al. ..... 430/382
4,914,002 4/1990 Inoue et al. ..... 430/264
4,923,787 5/1990 Harder ..... 430/489

FOREIGN PATENT DOCUMENTS 63-046450 2/1988 Japan .

OTHER PUBLICATIONS

Grant & Hackh's Chemical Dictionary, 5th Edition pp. 560 and 561.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material which provides a negative image contains a compound represented by formula (I):

$$R-NHNH-\underset{\underset{O}{\|}}{C}-(Time)_n-Z \qquad (I)$$

wherein R represents an aliphatic group, an aromatic group, or a heterocyclic group; Z represents a development inhibitor group containing an anionic functional group as a partial structure; "Time" represents a divalent group; and n is 0 or 1.

14 Claims, 1 Drawing Sheet

FIGURE
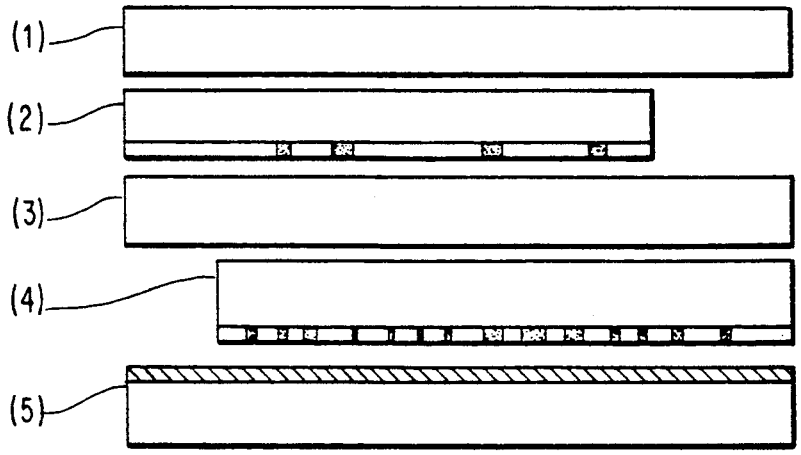

SILVER HALIDE PHOTOGRAPHIC MATERIAL

This is a continuation of application Ser. No. 07/511,165 filed Apr. 19, 1990, now abandoned.

FIELD OF THE INVENTION

This invention relates to a silver halide photographic material and, more particularly, to a silver halide photographic material which provides a negative image having high contrast, high sensitivity, and satisfactory dot image quality.

BACKGROUND OF THE INVENTION

In the field of photomechanical systems, there is a demand for satisfactory image reproducibility, stable processing solutions, and simplification of replenishment, in order to cope with the recent diversity and complexity of printed materials.

In particular, originals in line work comprise photocomposed letters, hand-written letters, illustrations, dot prints, etc. and thus contain images having different densities and line widths. There has therefore been a demand to develop a process camera, a photographic light-sensitive material and an image formation system which would enable one to reproduce an original with high fidelity. In the photomechanical reproduction of catalogues or large posters, enlargement or reduction of a dot print is often required. When a dot print is enlarged in plate making, the line number per inch is reduced and the dots are blurred. When a dot print is reduced, the line number per inch increases, and the dots become finer Accordingly, there has been a demand for an image formation system having a broader latitude to maintain reproducibility of halftone gradation.

A halogen lamp or a xenon lamp is employed as a light source for a process camera In order to obtain photographic sensitivity to these light sources, photographic materials are usually subjected to orthochromatic sensitization. However, orthochromatic materials are susceptible to influences of chromatic aberration of a lens and thus likely to suffer from deterioration of image quality. The deterioration is conspicuous when a xenon lamp is the light source.

Known systems to meet the demand for a broad latitude include one in which a lith silver halide light-sensitive material comprising silver chlorobromide (containing at least 50% of silver chloride) is processed with a hydroquinone developer having an extremely low sulfite ion effective concentration (usually 0.1 mol/l or less). A line or dot image is thereby obtained having high contrast and high density in which image areas and non-image areas are clearly distinguishable. With this method, however, development is extremely unstable because of air oxidation due to the low sulfite concentration of the developer. Hence, various efforts and devices are required to stabilize the developing activity and, also, the processing speed is quite low, reducing work efficiency.

There is therefore a demand for an image formation system which eliminates the image formation instability associated with the above-described lith development system and provides an ultrahigh contrast image by using a processing solution having a satisfactory preservation stability. In this connection, a surface latent image type silver halide photographic material has been proposed containing a specific acylhydrazine compound, which is developed with a developing solution having a pH between 11.0 and 12.3 and containing at least 0.15 mol/l of a sulfite preservative. This material exhibits satisfactory preservation stability to form an ultrahigh contrast negative image having a gamma exceeding 10 as disclosed in U.S. Pat. Nos. 4,166,742, 4,168,977, 4,221,857, 4,224,401, 4,243,739, 4,272,606, and 4,311,781. This new image formation system is characterized in that silver iodobromide and silver chloroiodobromide as well as silver chlorobromide are applicable thereto, whereas the conventional ultrahigh contrast image formation systems are applicable only to photographic materials comprising silver chlorobromide of a high silver chloride content.

While the above-described image formation system is excellent in sharpness of halftone dots, processing stability, speed, and reproducibility of originals, the recent diversity of prints has required further improvement in the reproduction of originals.

In an attempt to improve image quality, a method of using a redox compound having a carbonyl group which is capable of imagewise releasing a developing inhibitor has been suggested as disclosed, e.g., in JP-A-61-213847 (the term "JP-A" as used herein means an "unexamined published Japanese patent application"). However, extension of halftone gradation is insufficient, even with these compounds.

A light-sensitive material is therefore needed which, when developed with a stable developer, provides a high contrast dot image whose tone is broadly controllable.

On the other hand, improvement in working efficiency in a lay-out process and dot-to-dot work (a so-called contact work) has been attempted by performing the work in a brighter environment. Accordingly, light-sensitive materials for plate making which can be handled in an environment that may be called a bright room and exposure printers for these materials have been developed.

The term "light-sensitive material for a bright room" as used herein means a light-sensitive material which can be safely handled for a long time with a safe light which includes no ultraviolet light component and has a wavelength of substantially 400 nm or more.

A light-sensitive material for a bright room which can be used in a lay-out process and dot-do-dot work may be exposed to light while in intimate contact with a developed film having a letter or dot image (original) to effect negative-positive conversion or positive-positive conversion. The material must achieve negative-positive conversion of a dot image or a line or letter image according to the dot area or the line or letter image width of the original. Further, dot image tone or line or letter width must be controllable. Light-sensitive materials for bright room contact work which meet these requirements have been supplied.

However, when a conventional light-sensitive material for a bright room is used in bright room dot-to-dot work in the highly technical image conversion technique called superimposed letter image formation by contact work, the resulting white letter image has poor quality as compared to that obtained by the technique comprising dark room dot-to-dot work using a conventional light-sensitive material for dark room contact work.

The super-imposed letter image formation by contact work is illustrated in detail by reference to the sole FIGURE of this specification. A film (2) having a letter or line image shown in black (line original) and a film (4) having a dot image shown in black (dot original) are adhered to transparent or semi-transparent bases (1) and (3), respectively. Bases (3), and (4) usually are polyethylene terephthalate films having a thickness of about 100 μm. The line original and the dot original are superposed on each other to make an original. The emulsion layer (shaded part) of a light-sensitive material (5) for dot-to-dot work is brought into contact with the dot original (4) and exposed to light. The exposed light-sensitive material is then subjected to development to form a white line image within a dot image.

What is important in the above-described superimposed letter image formation is that the negative-positive conversion should be conducted precisely according to the dot area of the dot original and the line width of the line original. As is apparent from the FIGURE, the dot original (4) is in intimate contact with the emulsion layer of the light-sensitive material (5). On the other hand, line original (2) is not directly superposed on light-sensitive material (5), but base (3) and dot original (4) are interposed therebetween. Therefore, when material (5) is exposed to light at an exposure amount sufficient to effect negative-positive conversion faithfully to the dot original, the exposure through the line original is through base (3) and dot original (4), causing a reduction of the line width of the transparent line image. This causes deterioration of the super-imposed letter image quality.

In order to solve the above-described problem, systems using a hydrazine derivative have been proposed as disclosed in JP-A-62-80640, JP-A-62-235938, JP-A-235939, JP-A-63-104046, JP-A-103235, JP-A-63-296031, JP-A-63-314541, and JP-A-64-13545, but sufficient effects have not yet been obtained, leaving a need for further improvements.

SUMMARY OF THE INVENTION

One object of the present invention is to provide a photographic light-sensitive material having a broad exposure latitude in line image formation, an ultrahigh contrast (particularly having a gamma of 10 or more), and a high resolving power.

Another object of the present invention is to provide an ultrahigh contrast photographic light-sensitive material which satisfactorily reproduces a line image with a high background density ($D_{max}$).

A further object of the present invention is to provide an ultrahigh contrast photographic light-sensitive material having a broad exposure latitude in dot image formation and providing excellent dots having a high density, a sharp outline, and a uniform shape.

These and other objects of the present invention are accomplished by a silver halide photographic material containing a compound represented by formula (I):

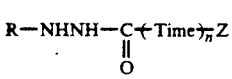

$$R-NHNH-\underset{\underset{O}{\|}}{C}\text{-}(Time)_n\text{-}Z \qquad (I)$$

wherein R represents an aliphatic group, an aromatic group, or a heterocyclic group; Z represents a development inhibitor group containing an anionic functional group as a partial structure; "Time" represents a divalent group; and n is 0 or 1.

The compound represented by formula (I) is capable of releasing a development inhibitor represented by $Z^{\ominus}$ or ZH via the following route after it is oxidized with the oxidation product of a developer:

When n is 0,

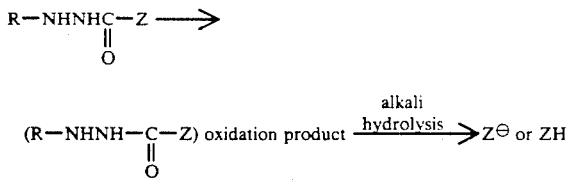

$$R-NHNH-\underset{\underset{O}{\|}}{C}-Z \longrightarrow$$

$$(R-NHNH-\underset{\underset{O}{\|}}{C}-Z)\ \text{oxidation product} \xrightarrow[\text{hydrolysis}]{\text{alkali}} Z^{\ominus}\ \text{or}\ ZH$$

When n is 1,

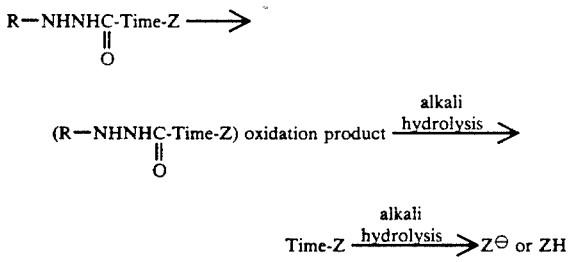

$$R-NHNH-\underset{\underset{O}{\|}}{C}\text{-Time-}Z \longrightarrow$$

$$(R-NHNH-\underset{\underset{O}{\|}}{C}\text{-Time-}Z)\ \text{oxidation product} \xrightarrow[\text{hydrolysis}]{\text{alkali}}$$

$$\text{Time-}Z \xrightarrow[\text{hydrolysis}]{\text{alkali}} Z^{\ominus}\ \text{or}\ ZH$$

BRIEF DESCRIPTION OF THE DRAWING

The FIGURE illustrates a structure at the time of exposure during the formation of a super-imposed letter image by contact work.

DETAILED DESCRIPTION OF THE INVENTION

The term "alkyl" or "alkoxy" group as used herein means those having 1 to 30 carbon atoms, preferably 1 to 20 carbon atoms; the term "alkenyl" or "alkynyl" group as used herein means those having 2 to 30 carbon atoms, preferably 2 to 20 carbon atoms; the term "aryl" group as used herein means those having 6 to 30 carbon atoms, preferably 6 to 20 carbon atoms; and the term "aralkyl" group as used herein means those having 7 to 30 carbon atoms, preferably 7 to 20 carbon atoms.

In formula (I), the aliphatic group represented by R includes a straight chain, a branched or cyclic alkyl, an alkenyl or an alkynyl group.

The aromatic group represented by R includes a monocyclic or a bicyclic aryl group, e.g., phenyl and naphthyl groups.

The heterocyclic group (heterocyclic ring) represented by R includes a saturated or unsaturated 3- to 10-membered hetero ring containing at least one nitrogen, oxygen or sulfur atom. The hetero ring may be monocyclic or may form a condensed ring with other aromatic or heterocyclic rings. The hetero ring preferably includes a 5- or 6-membered aromatic heterocyclic group, e.g., those containing a pyridyl group, an imidazolyl group, a quinolinyl group, a benzimidazolyl group, a pyrimidyl group, a pyrazolyl group, an isoquinolinyl group, a thiazolyl group, or a benzthiazolyl group.

Preferred as R is an aromatic group.

R may have a substituent. Examples of suitable substituents for R include an alkyl group, an aralkyl group, an alkenyl group, an alkynyl group, an alkoxy group, an aryl group, a substituted amino, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamido group, a sulfonamido group, a nitro group, and a group represented by formula (II):

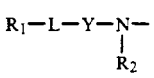

(II)

wherein Y represents

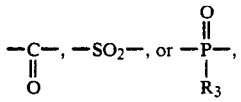

wherein $R_3$ represents an alkoxy group or an aryloxy group; L represents a single bond, —O—, —S—, or

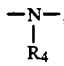

wherein $R_4$ represents a hydrogen atom, an aliphatic group, or an aromatic group; and $R_1$ and $R_2$, which may be the same or different, each represents a hydrogen atom, an aromatic group, an aliphatic group, or a heterocyclic group, or $R_1$ and $R_2$ are connected to each other to form a ring.

R may comprise one or more of the groups represented by formula (II).

In formula (II), the aliphatic group represented by $R_1$ includes a straight chain, branched or cyclic alkyl, alkenyl or alkynyl group.

The aromatic group represented by $R_1$ includes a monocyclic or bicyclic aryl group, e.g., phenyl and naphthyl groups.

The heterocyclic group represented by $R_1$ includes a saturated or unsaturated 3- to 10-membered hetero ring containing at least one nitrogen, oxygen or sulfur atom. The hetero ring may be monocyclic or may form a condensed ring with other aromatic or heterocyclic rings. The hetero ring preferably includes a 5- or 6-membered aromatic heterocyclic group, e.g., those containing a pyridyl group, an imidazolyl group, a quinolinyl group, a benzimidazolyl group, a pyrimidyl group, a pyrazolyl group, an isoquinolinyl group, a thiazolyl group, or a benzthiazolyl group.

$R_1$ may have a substituent. Examples of suitable substituents for $R_1$ include an alkyl group, an aralkyl group, an alkenyl group, an alkynyl group, an alkoxyl group, an aryl group, a substituted amino, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an alkyloxycarbonyl group, an aryloxycarbonyl group, an acyl group, an alkoxycarbonyl group, an acyloxy group, a carbonamido group, a sulfonamido group, and a nitro group. These substituents may further be substituted and may be taken together, if possible, to form a ring.

The aliphatic group represented by $R_2$ includes a straight chain, branched or cyclic alkyl, alkenyl or alkynyl group.

The aromatic group represented by $R_2$ includes a monocyclic or bicyclic aryl group, e.g., a phenyl group.

$R_2$ may have a substituent, such as those mentioned as the substituent of $R_1$.

$R_1$ and $R_2$ may be taken together, if possible, to form a ring.

$R_2$ preferably represents a hydrogen atom.

Y preferably represents

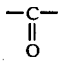

L preferably represents a single bond or

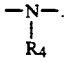

The aliphatic group represented by $R_4$ includes a straight chain, branched or cyclic alkyl, alkenyl or alkynyl group.

The aromatic group represented by $R_4$ includes a monocyclic or bicyclic aryl group, e.g., a phenyl group.

$R_4$ may have a substituent, such as those mentioned as the substituent of $R_1$.

$R_4$ preferably represents a hydrogen atom.

R in formula (I) may have a substituent containing a group which accelerates adsorption onto silver halide (hereinafter referred to as an adsorption accelerating group).

The adsorption accelerating group with which R may be substituted is represented by formula $X\text{-}(L')_t$, wherein X represents an adsorption accelerating group; L' represents a divalent linking group; and t represents 0 or 1.

Examples of suitable adsorption accelerating groups represented by X include a thioamido group, a mercapto group, a group having a disulfide linkage, and a 5- or 6-membered nitrogen-containing heterocyclic group.

The thioamido adsorption accelerating group represented by X is a divalent group represented by

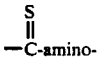

which may be a part of a cyclic structure or may be an acyclic thioamido group. Useful thioamido adsorption accelerating groups can be selected from those disclosed in U.S. Pat. Nos. 4,030,925, 4,031,127, 4,080,207, 4,245,037, 4,255,511, 4,266,013, and 4,276,364, and *Research Disclosure,* Vol. 151, No. 15162 (Nov., 1976) and ibid, Vol. 176, No. 17626 (Dec., 1978).

Specific examples of acyclic thioamido groups are thioureido, thiourethane and dithiocarbamic ester groups. Specific examples of cyclic thioamido groups are 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups may further be substituted.

The mercapto group represented by X includes an aliphatic mercapto group, an aromatic mercapto group, and a heterocyclic mercapto group. A heterocyclic mercapto group wherein the carbon atom to which —SH is bonded is adjacent to a nitrogen atom is the same as a cyclic thioamido group, being a tautomeric isomer of such a heterocyclic mercapto group. Specific examples of such a group are the same as those mentioned above with respect to the cyclic thioamido group.

The 5- or 6-membered nitrogen-containing heterocyclic group represented by X includes those composed of at least one carbon atom and at least one atom selected from nitrogen, oxygen, and sulfur atoms. Examples of preferred groups are benzotriazole, triazole, tetrazole, indazole, benzimidazole, imidazole, benzothiazole, thiazole, benzoxazole, oxazole, thiadiazole, oxadiazole, and triazine. These groups may further be substituted with an appropriate substituent. Substituents include those mentioned with respect to the substituents of R.

Preferred among the groups represented by X are a cyclic thioamido group (i.e., a mercapto-substituted nitrogen-containing heterocyclic group, e.g., 2-mercaptothiadiazole, 3-mercapto-1,2,4-triazole, 5-mercaptotetrazole, 2-mercapto-1,3,4-oxadiazole, and 2-mercaptobenzoxazole groups) and a nitrogen-containing heterocyclic group (e.g., benzotriazole, benzimidazole, and indazole groups).

$X\text{-}(L')_t$ may have two or more substituents which may be the same or different.

The divalent linking group represented by L' is an atom or atom group containing at least one carbon, nitrogen, sulfur, or oxygen atom. Examples of L' include an alkylene group, an alkenylene group, an alkynylene group, an arylene group, —O—, —S—, —NH—, —N=, —CO—, —$SO_2$—, etc., either alone or in combination thereof. These groups may have a substituent.

Specific examples of the linking group L' are —CONH—, —NHCONH—, —$SO_2$NH—, —COO—, —NHCOO—,

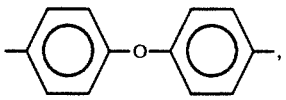

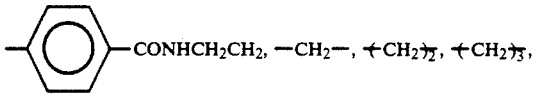

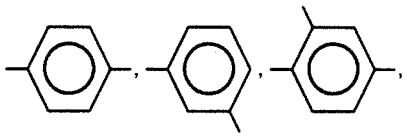

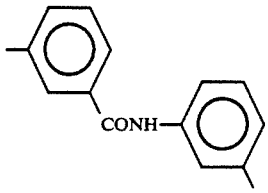

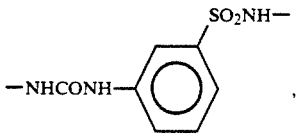

-continued

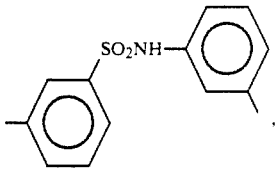

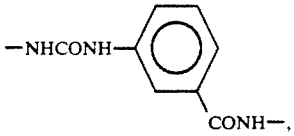

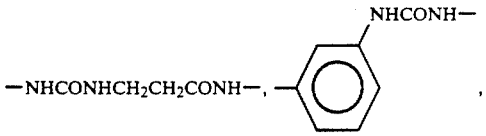

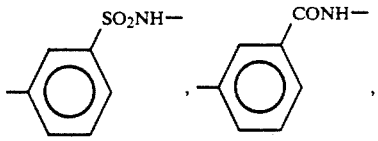

—$CH_2CH_2SO_2NH$—, and —$CH_2CH_2CONH$—.

These divalent groups may further have a substituent selected from those mentioned with respect to the substituents of R.

R may further contain a ballast group commonly employed in immobile photographic additives, such as couplers.

A ballast group is an organic group which has a molecular weight sufficient to substantially prevent the compound represented by formula (I) from diffusing into other layers or processing solutions. It comprises at least one of an alkyl group, an aryl group, a heterocyclic group, an ether group, a thioether group, an amido group, a ureido group, a urethane group, a sulfonamido group, etc. Preferred ballast groups are those having a substituted benzene ring, and more preferably those having a benzene ring substituted with a branched alkyl group.

In formula (I) the "Time" group represents a divalent linking group, which may have a timing adjustment function, and n represents 0 or 1. When n is 0, Z is directly bonded to the carbonyl group in the formula (I).

A divalent linking group represented by Time is a group capable of releasing Z from the moiety Time-Z which is released from the oxidation product of the redox nucleus. The release can be via a one step reaction or a reaction having plural steps.

Examples of the divalent linking group represented by Time include those which release Z by an intramolecular ring closure reaction of p-nitropenoxy derivatives as described in U.S. Pat. No. 4,248,962 (JP-A-54-145135); groups that release Z by a ring cleavage reaction followed by an intramolecular ring closure reaction as described in U.S. Pat. No. 4,310,612 (JP-A-55-53330) and U.S. Pat. No. 4,358,525; groups that release Z by an intramolecular ring closure reaction of the carboxyl group of succinic acid monoesters or their analogs with the formation of an acid anhydride as described in U.S.

Pat. Nos. 4,330,617, 4,446,216 and 4,483,919 and JP-A-59-121328; groups that release Z by an electron transfer of the aryloxy or heterocyclic oxy group via the conjugated double bond to form a quinomonomethane or its analog as described in U.S. Pat. Nos. 4,409,323 4,421,845, *Research Disclosure*, Item No. 21228 (December, 1981), U.S. Pat. No. 4,416,977 (JP-A-57-135944) and JP-A-58-209736 and JP-A-58-209738; groups that release Z by electron transfer of the enamine structure moiety of the nitrogen-containing heterocyclic ring from the gamma position of the enamine as described in U.S. Pat. No. 4,420,554 (JP-A-57-136640), JP-A-57-135945, JP-A-57-188035, JP-A-58-98728 and JP-A-58-209737; groups that release Z by an intramolecular ring closure reaction of the hydroxyl group formed by electron transfer of the carbonyl group conjugated with the nitrogen atom of the nitrogen-containing hetero ring as described in JP-A-57-56837; groups that release Z with the formation of aldehydes as described in U.S. Pat. No. 4,146,396 (JP-A-52-90932), JP-A-59-93442, JP-A-59-75475, JP-A-60-249148 and JP-A-60-249149; groups that release Z with the decarbonylation of carboxyl group as described in JP-A-51-146828, JP-A-57-179842 and JP-A-59-104641; groups having —O—COOCR$_2$-R$_6$—Z that release Z by decarbonylation followed by the formation of aldehydes; groups that release Z by the formation of isocyanates as described in JP-A-60-7429; and groups that release Z by a coupling reaction with the oxidation product of a color developing agent as described in U.S. Pat. No. 4,438,193.

The divalent group represented by Time in formula (I) can be preferably selected from those of the following formulae (T-1) to (T-6), wherein (*) indicates the position where Time is bonded to

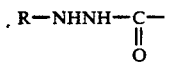

and (**) indicates the position where Time is bonded to Z.

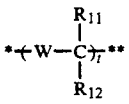

(T-1)

wherein W represents an oxygen, a sulfur atom or

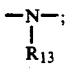

$R_{11}$ and $R_{12}$ each independently represents a hydrogen atom or a substituent; $R_{13}$ represents a substituent; t represents 1 or 2, and when t is 2, two

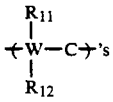

may be the same or different.

When $R_{11}$ and $R_{12}$ represent substituents, specific examples of the substituents are $R_{14}$—, $R_{14}CO$—, $R_{14}SO_2$—,

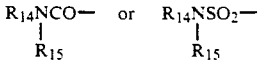

wherein $R_{14}$ represents an aliphatic group, an aromatic group or a heterocyclic group; and $R_{15}$ represents an aliphatic group, an aromatic group, a heterocyclic group, or a hydrogen atom. Examples of the substituents as $R_{13}$ include the same substituents as $R_{11}$ and $R_{12}$ as described above. $R_{11}$, $R_{12}$ and $R_{13}$ each may be a divalent group and may form a cyclic structure.

Specific examples of the groups represented by formula (T-1) are mentioned below.

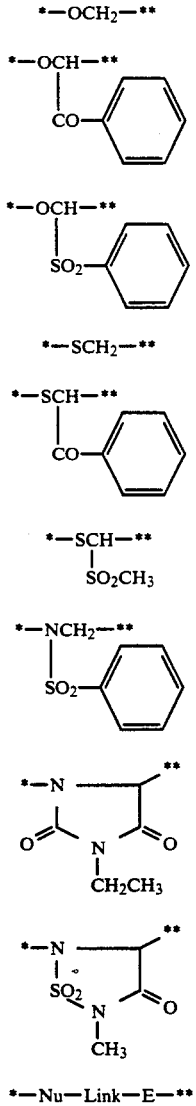

*—Nu—Link—E—** (T-2)

wherein Nu represents a nucleophilic group, and an oxygen atom or a sulfur atom are examples of nucleophilic nuclides; E represents an electrophilic group and it is nucleophilically attacked by Nu to be able to cleave the bond to the position of (**); Link represents a linking group which participates in the steric configuration of Nu and E so that Nu and E may be subjected to intramolecular nucleophilic substitution reaction therebetween.

Specific examples of the groups represented by formula (T-2) are mentioned below.
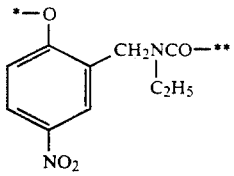
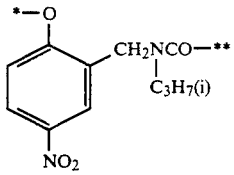
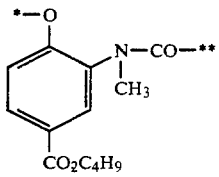
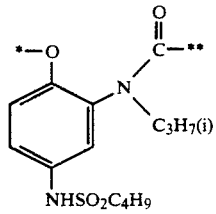
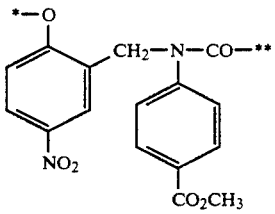
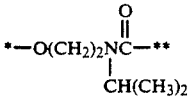
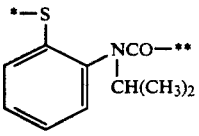
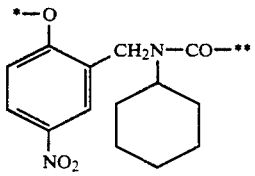
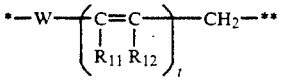
(T-3)
wherein W, $R_{11}$, $R_{12}$ and t have the same meaning as those in formula (T-1). Specific examples of the groups of formula (T-3) are mentioned below.
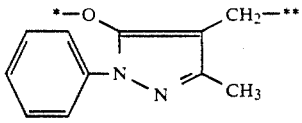
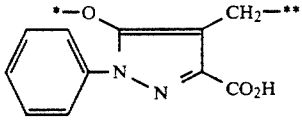
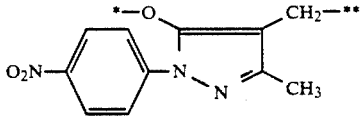
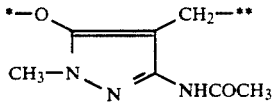
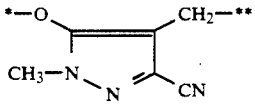
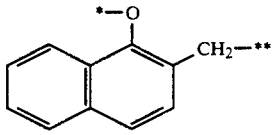
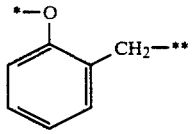
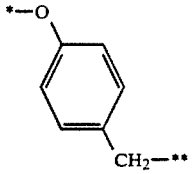
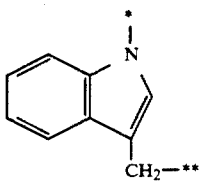
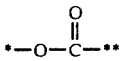
(T-4)
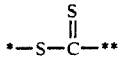
(T-5)

-continued

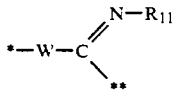

(T-6)

In these formulae, W and $R_{11}$ have the same meanings as those in formula (T-1). Specific examples of the groups of formula (T-6) are mentioned below.

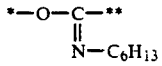

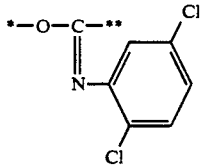

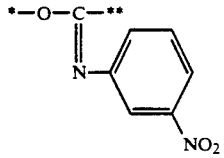

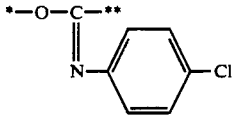

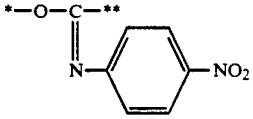

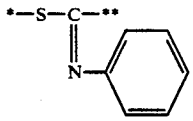

Specific examples of the divalent linking groups represented by Time are also described in detail in JP-A-61-236549 and JP-A-64-88451 and Japanese Patent Application No. 63-98803. Preferred examples of these groups are mentioned below.

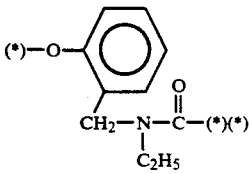

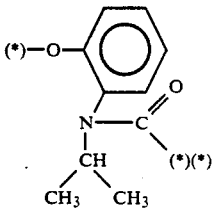

-continued

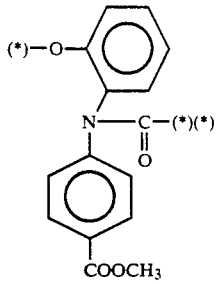

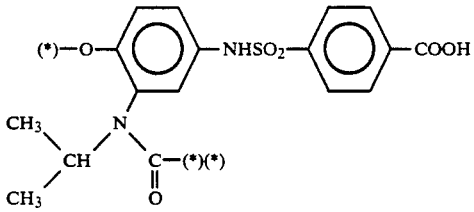

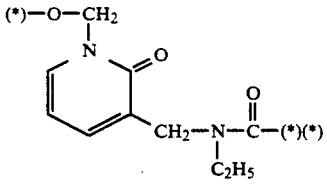

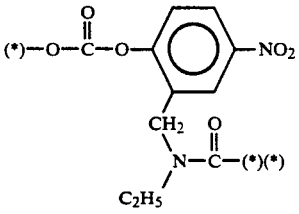

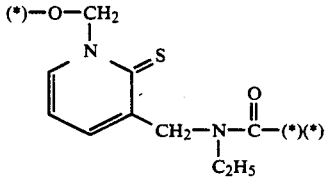

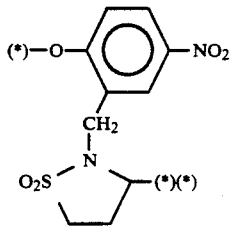

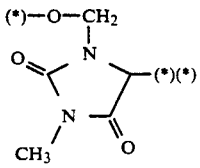

-continued
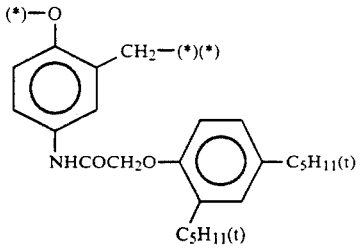
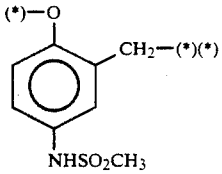
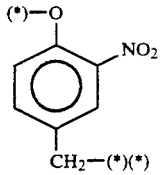
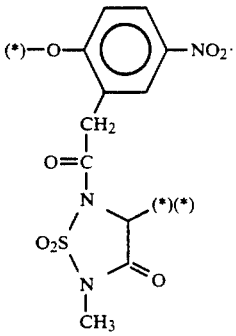
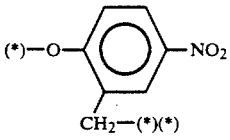
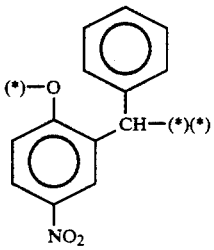
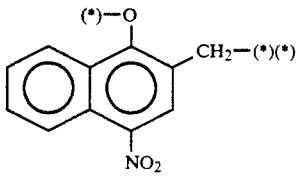
-continued
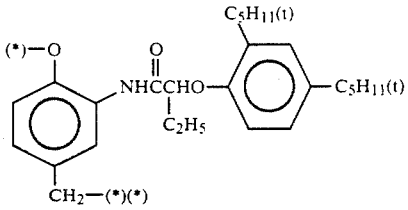
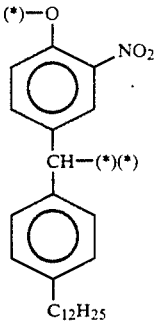
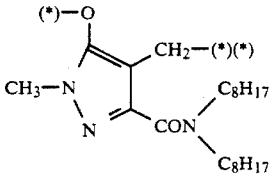
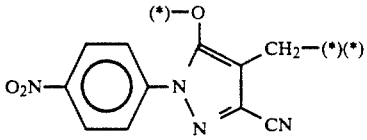
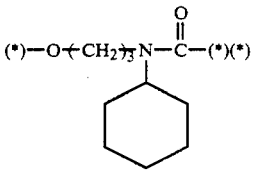
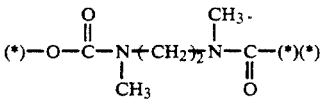
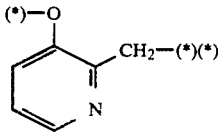
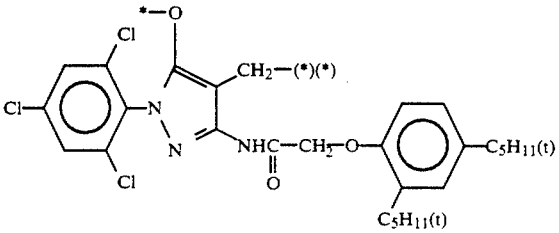

-continued

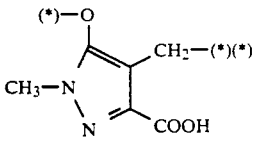

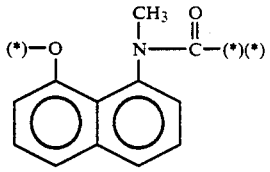

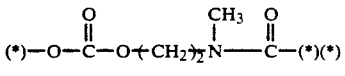

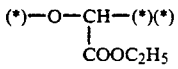

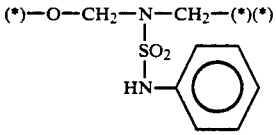

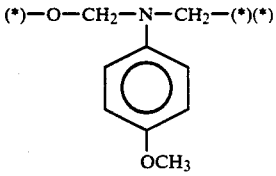

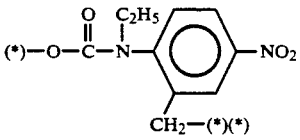

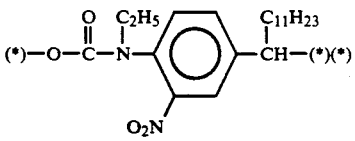

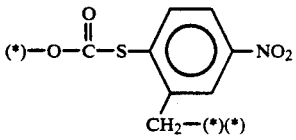

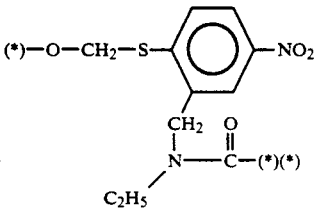

-continued

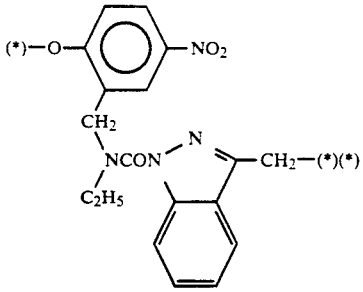

In formula (I), Z represents a development inhibitor group containing an anionic functional group as a partial structure. Preferred examples of the anionic functional group include a sulfo group, a carboxyl group, a sulfamoyl group, a phosphono group, a phosphinyl group, an arsono group, a sulfoxy group, a sulfoamino group, and a salt thereof. Particularly preferred anionic functional groups include a sulfo group, a carboxyl group, and a salt thereof. Z may contain two or more anionic groups.

Examples of the development inhibitor group represented by Z are described below. These examples are, however, described in terms of the compounds wherein the anionic functional group is replaced by a hydrogen atom. (1) Compounds having a mercapto group bonded to a heterocyclic ring (including compounds having a thioamido group which are tautomers of the above mercapto compounds when the —SH group is bonded to the ring carbon atom and the ring atom adjacent to this carbon atom is a nitrogen atom).

Examples of such compounds include mercaptoazoles, such as 1-phenyl-5-mercaptotetrazole, 1-(3-hydroxyphenyl)-5-mercaptotetrazole, 1-(3-hexanoylaminophenyl)-5-mercaptotetrazole, 1-ethyl-5-mercaptotetrazole, 2-methylthio-5-mercapto-1,3,4-thiadiazole, 2-ethylthio-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[(3-(3-methylureido)-phenyl]-5-mercaptotetrazole, 1-(4-nitrophenyl)-5-mercaptotetrazole, 5-(2-ethylhexanoylamino)-2-mercaptobenzimidazole, etc.; mercaptoazaindenes, such as 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, 4,6-dimethyl-2-mercapto-1,3,3a,7-tetraazaindene, etc.; mercaptopyrimidines, such as 2-mercaptopyrimidine, 2-mercapto-4-methyl-6-hydroxypyrimidine, 2-mercapto-4-propylpyrimidine, etc. (2) Heterocyclic compounds, for example, benzotriazoles, such as benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butyl-benzotriazole, 5-nitro-6-chlorobenzotriazole, 6-chloro-4-nitrobenzotriazole, 5,6-dimethylbenzotriazole, 4,5,6,7-tetrachlorobenzotriazole, etc.; indazoles, such as indazole, 5-nitroindazole, 3-nitroindazole, 3-chloro-5-nitroindazole, 3-cyanoindazole, 3-n-butylcarbamoylindazole, 5-nitro-3-methanesulfonylindazole, etc.; benzimidazoles, such as 5-nitrobenzimidazole, 4-nitrobenzimidazole, 2-trifluoromethyl-5-nitrobenzimidazole, 5,6-dichlorobenzimidazole, 5-cyano-6-chlorobenzimidazole, 5-trifluoromethyl-6-chlorobenzimidazole, etc.; azaindenes, such as 4-hydroxy-6-methyl-5-nitro-1,3,3a,7-tetraazaindene, etc.; azoles, such as 5-(4-nitrophenyl)tetrazole, etc.

These development inhibitors may have substituents, and examples of substituents include a mercapto group, a nitro group, a hydroxyl group, an alkyl group, an aralkyl group, an alkenyl group, an alkynyl group, an aryl group, an alkoxy group, an aryloxy group, an amino group, an acylamino group, a sulfonylamino group, a ureido group, a urethane group, a carbamoyl group, an alkylthio group, an arylthio group, a sulfonyl group, a sulfinyl group, a halogen atom, a cyano group, an alkyloxycarbonyl group, an aryloxycarbonyl group, an acyl group, an alkoxycarbonyl group, an acyloxy group, a carbonamido group, a sulfonamido group, and a phosphonamido group.

Specific examples of the compounds represented by formula (I) are shown below as Compounds (I-1) to (I-42) for illustrative purposes only but not for limitation.

(I-1)

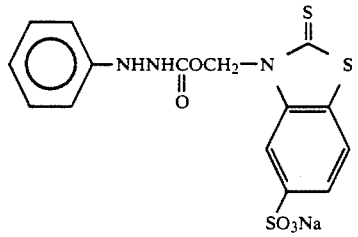

(I-2)

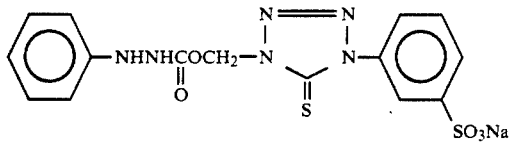

(I-3)

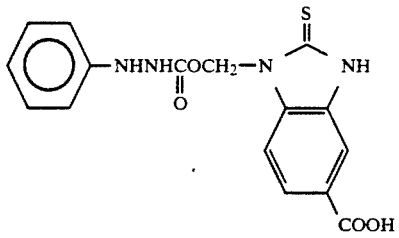

(I-4)

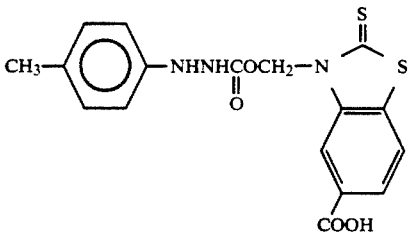

(I-5)

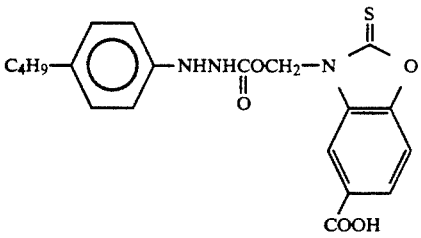

(I-6)

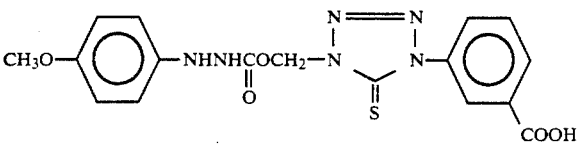

-continued
(I-7)
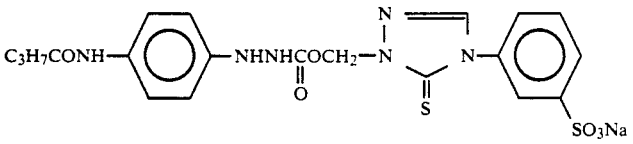
(I-8)
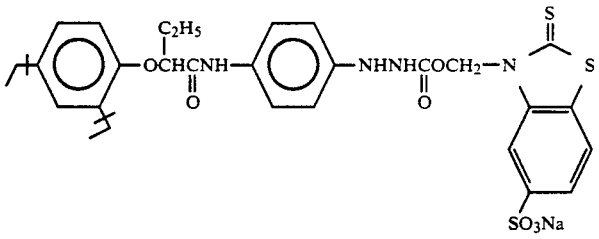
(I-9)
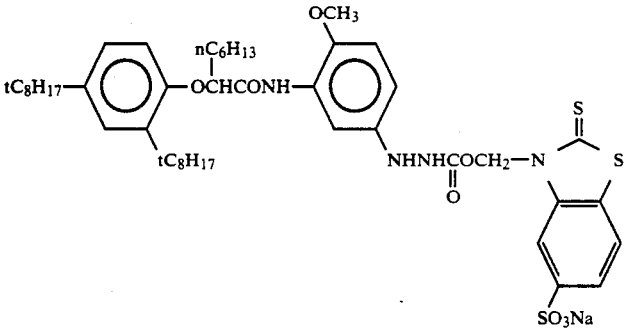
(I-10)
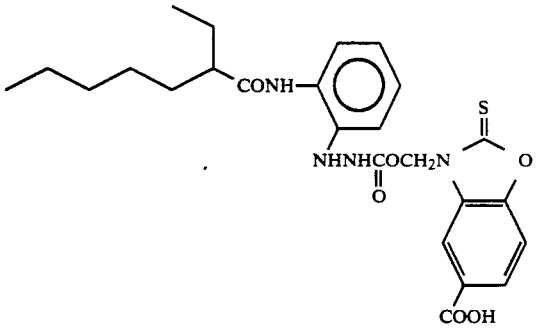
(I-11)
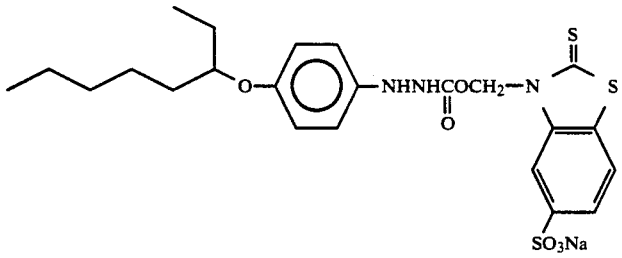
(I-12)
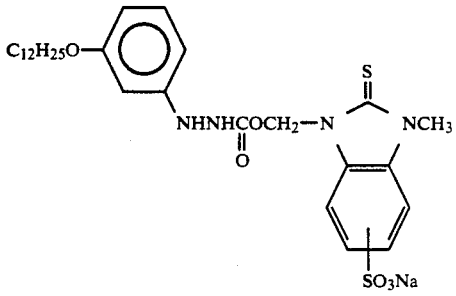

-continued
(I-13)
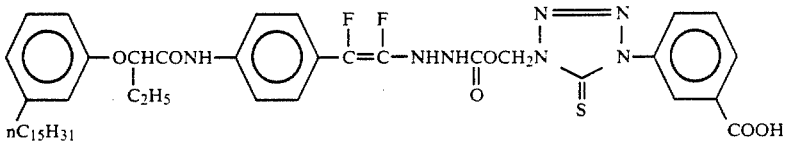
(I-14)
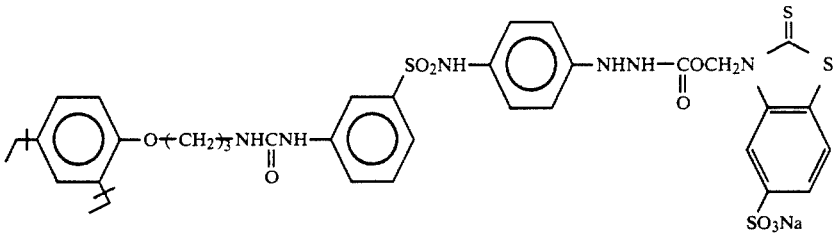
(I-15)
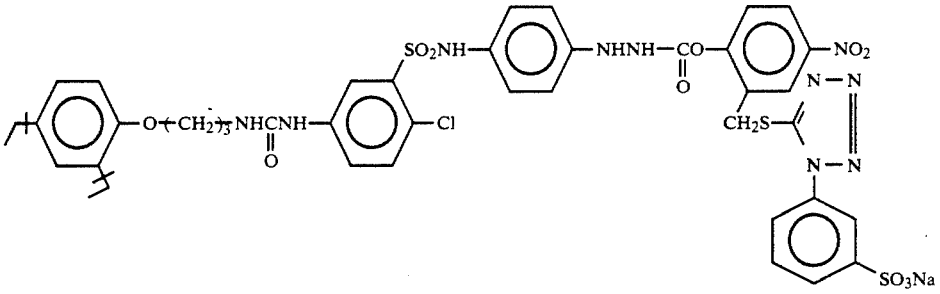
(I-16)
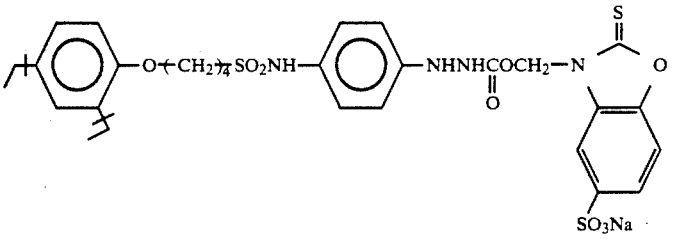
(I-17)
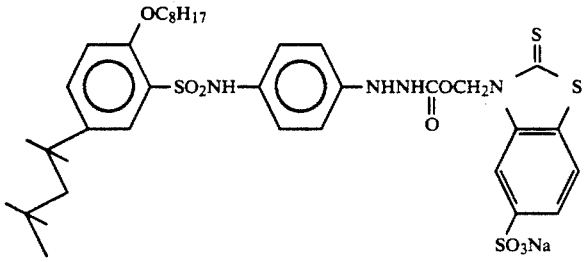
(I-18)
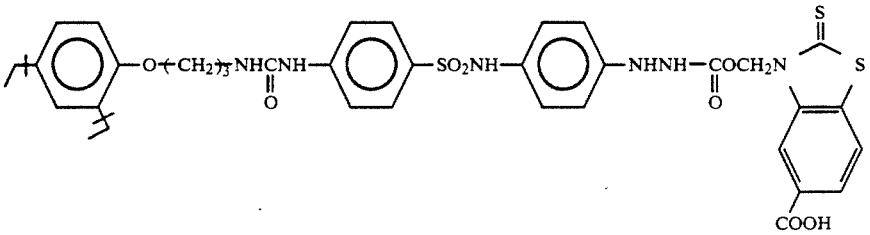

-continued
(I-19)
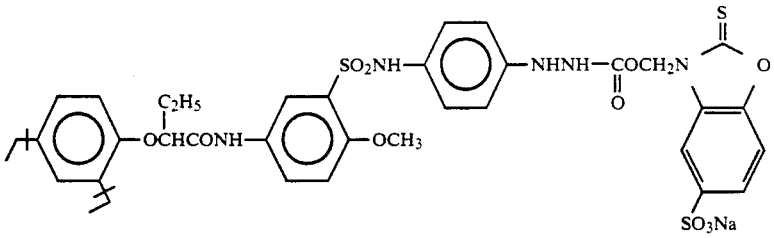
(I-20)
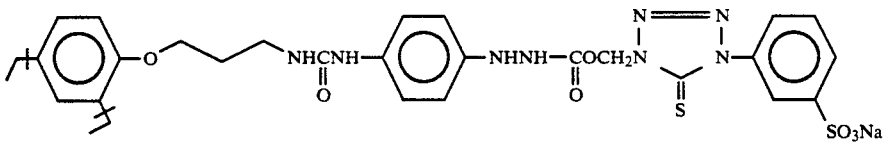
(I-21)
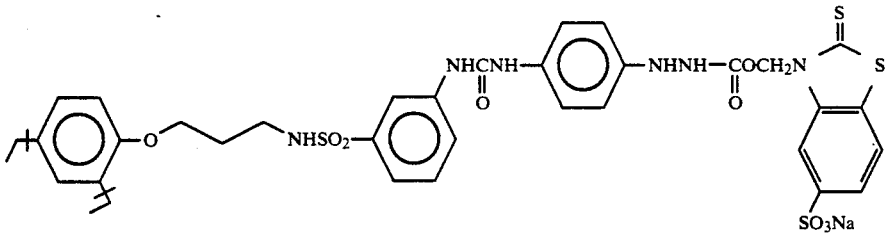
(I-22)
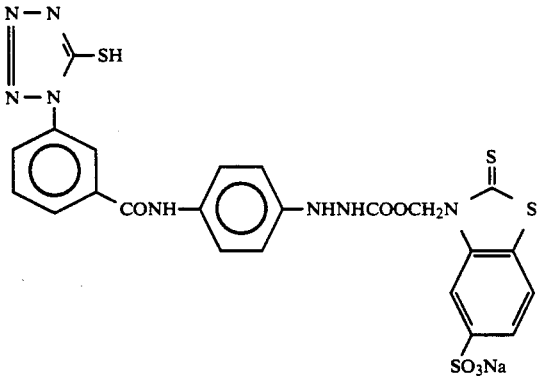
(I-23)
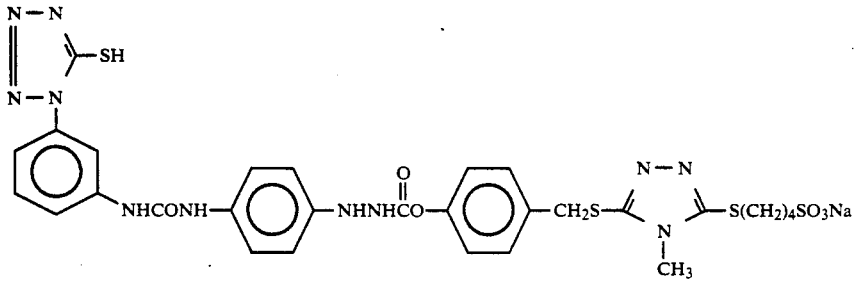

-continued
(I-24)
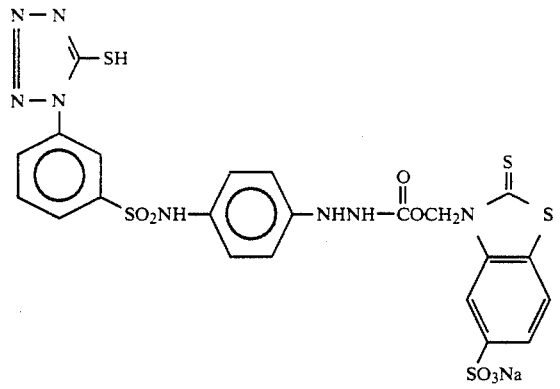
(I-25)
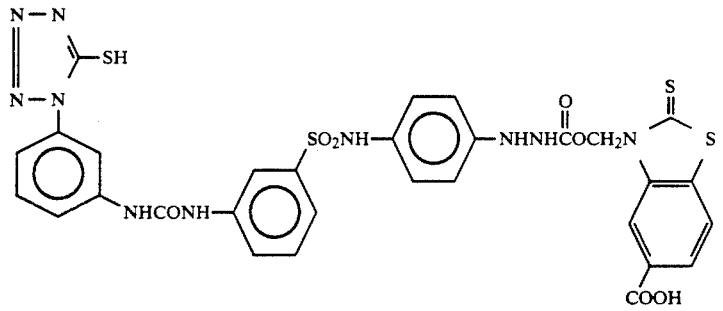
(I-26)
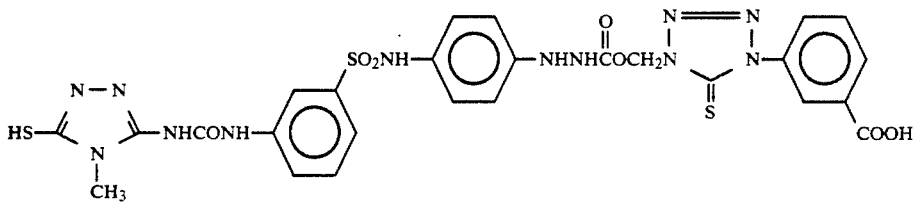
(I-27)
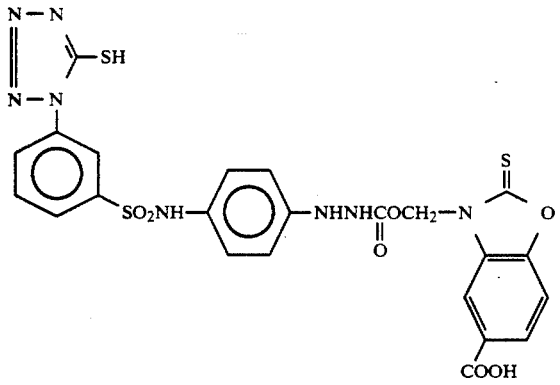
(I-28)
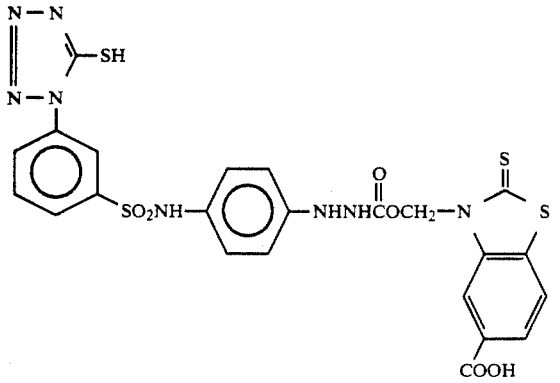

-continued
(I-29)
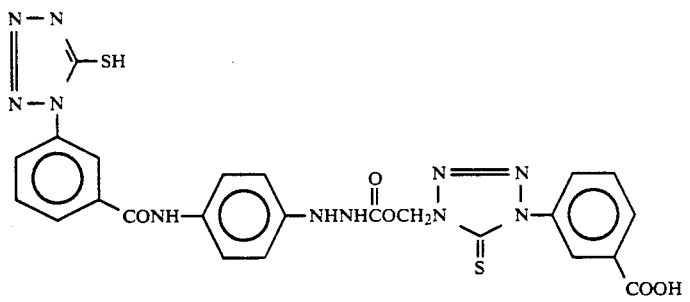
(I-30)
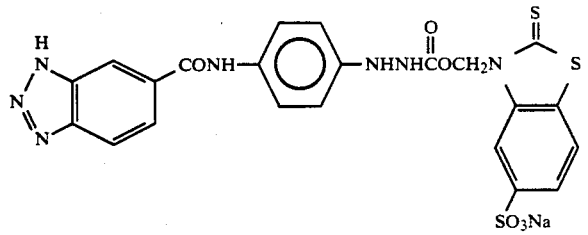
(I-31)
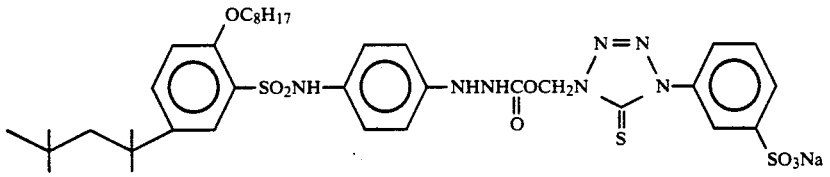
(I-32)
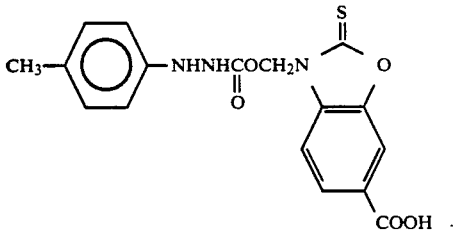
(I-33)
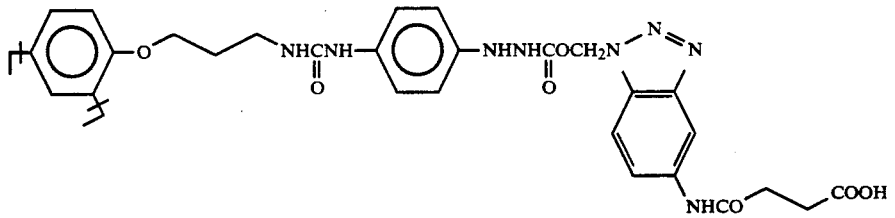
(I-34)
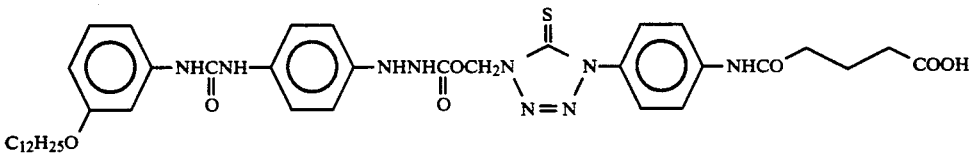
(I-35)
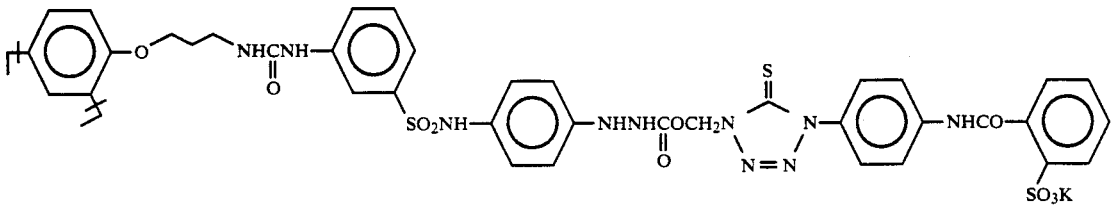

-continued
(I-36)
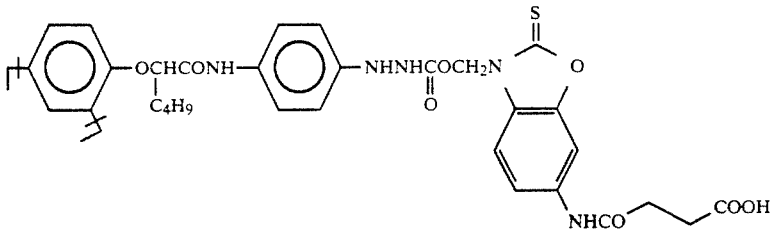
(I-37)
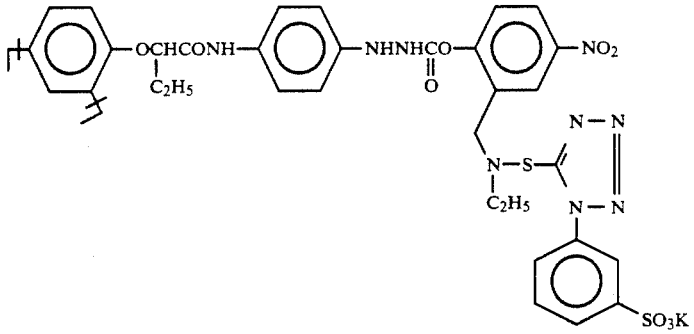
(I-38)
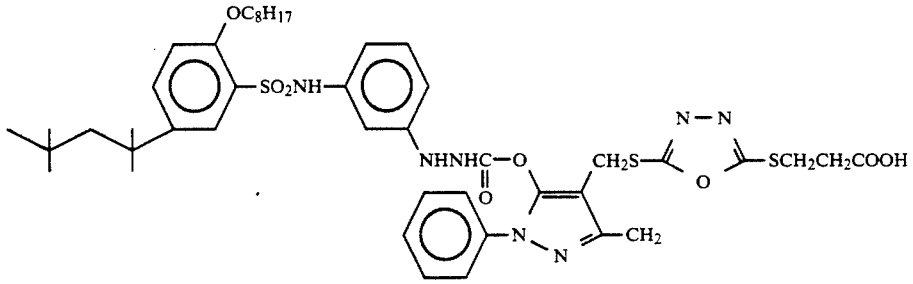
(I-39)
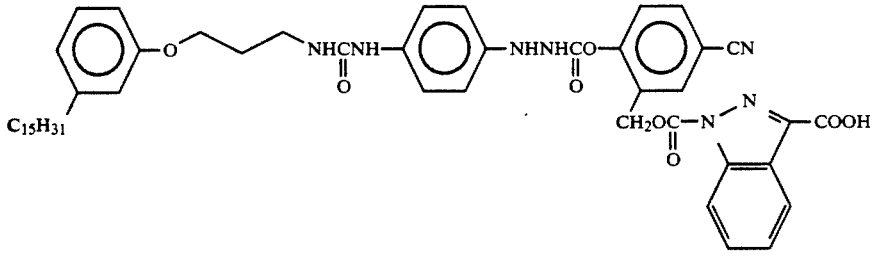
(I-40)
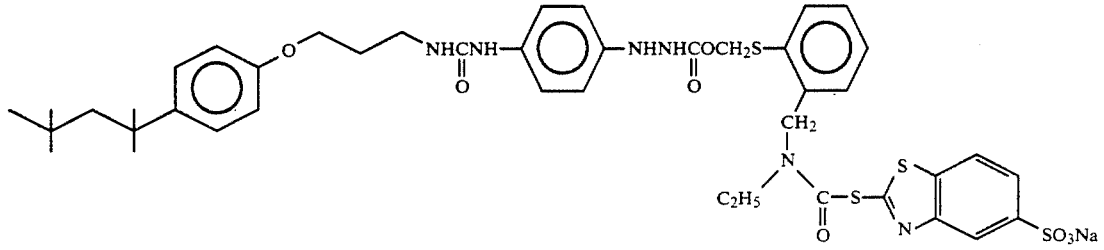

-continued (I-41)

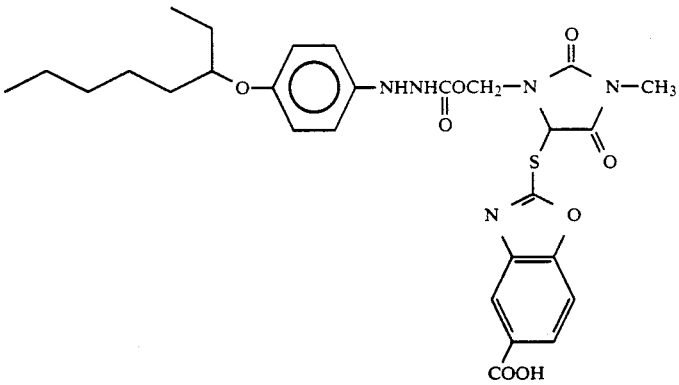

(I-42)

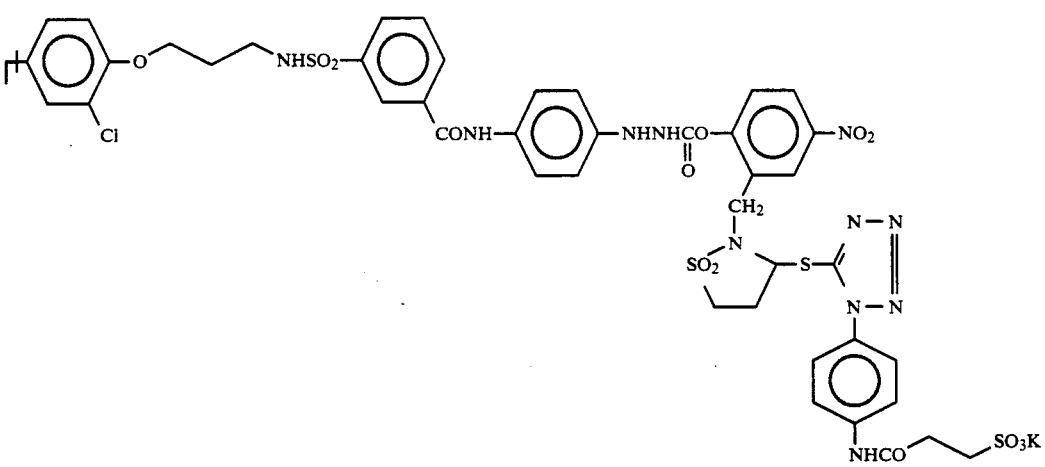

The compounds of formula (I) according to the present invention can be synthesized according to the procedures as described in JP-A-61-213847 and JP-A-62-260153.

More specifically, these compounds of formula (I) can be prepared by alternative procedures depending upon the type of the compounds to be prepared, i.e., (1) a process for producing the compound in which an anionic group has been protected, and then removing the protective group, (2) a process for producing the compound having a functional group which is different from the desired anionic group and then introducing the desired anionic group by conversion of the functional group, and (3) a process for producing directly the compound having the desired anionic group.

For example, Compound I-32 can be prepared by the process (1) which comprises synthesizing the corresponding t-butyl carboxylate by the conventional process and then removing the protective group with trifluoroacetic acid to produce the desired Compound I-32.

Compound I-36 can be prepared by the above process (2) via the following route.

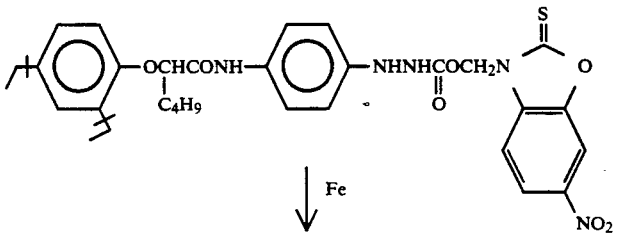

-continued

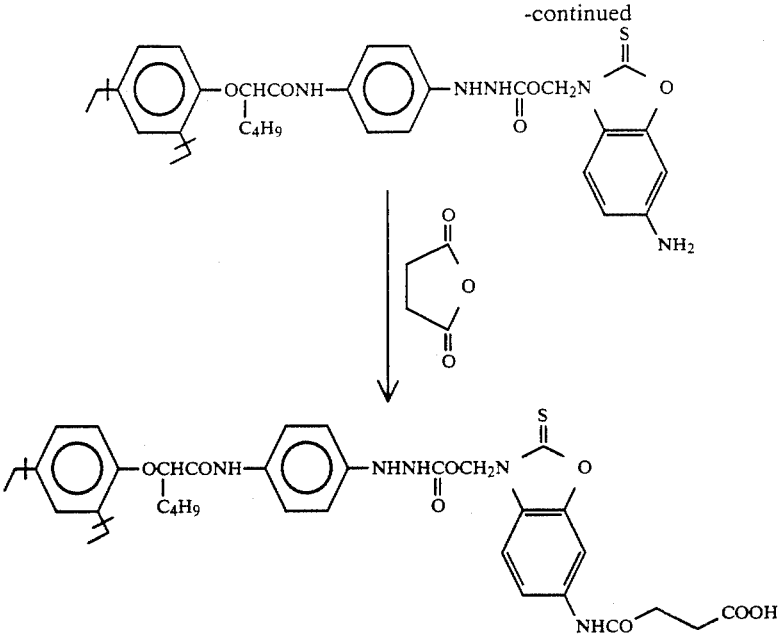

Compound I-36

Compound I-31 can be prepared by the process (3) above, and a typical procedure for the production of Compound I-31 is set forth below.

SYNTHESIS EXAMPLE OF COMPOUND I-31

10.0 g of p-nitrophenyl chlorocarbonate was added to a mixture of 12.8 g of the compound having the formula

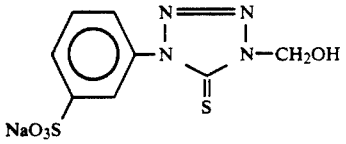

200 ml of sulfolane and 6.0 ml of pyridine at room temperature, and the resulting mixture was stirred for 8 hours. Then, 27 g of the compound having the formula

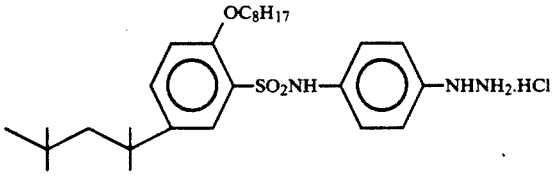

prepared by hydrolyzing the corresponding formylhydrazine with hydrochloric acid was added to the mixture. Then, 12 ml of triethylamine was added thereto, and the resulting mixture was stirred at room temperature for 15 hours. The mixture was poured into 1 N hydrochloric acid and extracted with ethyl acetate. The organic layer was concentrated to dryness, and the residue was purified by column chromatography to obtain the desired compound. (Yield, 13.3 g) The chemical structure of the product was confirmed by NMR spectrum, IR spectrum and elementary analysis.

The compound of formula (I) is incorporated into a photographic hydrophilic colloid emulsion layer or another hydrophilic colloidal layer by dissolving the compound in water or a water-miscible organic solvent (if desired, an alkali hydroxide or a tertiary amine may be added to form a salt) and adding the solution to a hydrophilic colloid solution (e.g., a silver halide emulsion, a gelatin aqueous solution, etc.). If desired, the pH of the resulting mixture may be adjusted by addition of an acid or an alkali.

The compounds of formula (I) of the present invention can be used either individually or in a combination of two or more thereof. The amount to be added is selected appropriately depending on the properties of the silver halide emulsion with which it is to be combined, preferably ranging from $1\times10^{-5}$ to $5\times10^{-2}$ mol, more preferably from $2\times10^{-5}$ to $1\times10^{-2}$ mol, per mol of silver halide.

It is preferable that the compound of formula (I) according to the present invention be used in combination with a hydrazine compound represented by formula (III):

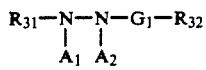

(III)

wherein $R_{31}$ represents an aliphatic group or an aromatic group; $R_{32}$ represents a hydrogen atom, an alkyl group, an aryl group, an alkoxy group, an aryloxy group, an amino group, a carbamoyl group, or an oxycarbonyl group; $G_1$ represents a carbonyl group, a sulfonyl group, a sulfoxy group, a

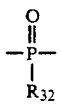

group, or an iminomethylene group; $A_1$ and $A_2$ each represents a hydrogen atom, or one of $A_1$ and $A_2$ represents a hydrogen atom and the other represents a substituted or unsubstituted alkylsulfonyl group, a substituted or unsubstituted arylsulfonyl group, or a substituted or unsubstituted acyl group.

In formula (III), the aliphatic group represented by $R_{31}$ preferably includes those containing from 1 to 30 carbon atoms, and more preferably a straight chain, branched or cyclic alkyl group having from 1 to 20 carbon atoms. The branched alkyl group may be cyclized to form a saturated heterocyclic ring containing at least one hetero atom. Further, the alkyl group may be substituted with an aryl group, an alkoxy group, a sulfoxy group, a sulfonamido group, a carbonamido group, etc.

The aromatic group represented by $R_{31}$ is a monocyclic or bicyclic aryl group or an unsaturated heterocyclic group. The unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those containing a benzene ring being particularly preferred.

$R_{31}$ preferably represents an aryl group.

The aryl group or unsaturated heterocyclic group represented by $R_{31}$ may have a substituent typically including an alkyl group, an aralkyl group, an alkenyl group, an alkynyl group, an alkoxyl group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a phosphoric acid amide group, a diacylamino group, and an imido group. Preferred among these substituents are a straight chain, branched or cyclic alkyl group (more preferably, having from 1 to 20 carbon atoms), an aralkyl group (more preferably, a monocyclic or bicyclic group having from 1 to 3 carbon atoms in the alkyl moiety thereof), an alkoxyl group (more preferably, having from 1 to 20 carbon atoms), a substituted amino group (more preferably, an amino group substituted with an alkyl group having from 1 to 20 carbon atoms), an acylamino group (more preferably, having from 2 to 30 carbon atoms), a sulfonamido group (more preferably, having from 1 to 30 carbon atoms), a ureido group (more preferably, having from 1 to 30 carbon atoms), and a phosphoric acid amide group (more preferably, having from 1 to 30 carbon atoms).

The alkyl group represented by $R_{32}$ in formula (III) preferably contains from 1 to 4 carbon atoms and may have a substituent, e.g., a halogen atom, a cyano group, a carboxyl group, a sulfo group, an alkoxyl group, a phenyl group, or a sulfonyl group.

The aryl group represented by $R_{32}$ preferably includes a monocyclic or bicyclic aryl group, such as those containing a benzene ring. The aryl group may have a substituent, e.g., a halogen atom, an alkyl group, a cyano group, a carboxyl group, a sulfo group, or a sulfonyl group.

The alkoxy group represented by $R_{32}$ preferably contains from 1 to 8 carbon atoms and may be substituted with a halogen atom, an aryl group, etc.

The aryloxy group represented by $R_{32}$ is preferably monocyclic and may be substituted with a halogen atom, etc.

The amino group represented by $R_{32}$ may be substituted with an alkyl group, a halogen atom, a cyano group, a nitro group, a carboxyl group, etc. Preferred among the amino groups are an unsubstituted amino group, an alkylamino group having from 1 to 10 carbon atoms, and an arylamino group.

The carbamoyl group represented by $R_{32}$ may be substituted with an alkyl group, a halogen atom, a cyano group, a carboxyl group, etc. Preferred among the carbamoyl groups are an unsubstituted carbamoyl group, an alkylcarbamoyl group having from 1 to 10 carbon atoms, and an arylcarbamoyl group.

The oxycarbonyl group represented by $R_{32}$ preferably includes an alkoxycarbonyl group having from 1 to 10 carbon atoms and an aryloxycarbonyl group. The hydroxycarbonyl group may be substituted with an alkyl group, a halogen atom, a cyano group, a nitro group, etc.

Where $G_1$ is a carbonyl group, $R_{32}$ preferably represents a hydrogen atom, an alkyl group (e.g., methyl, trifluoromethyl, 3-hydroxypropyl, 3-methanesulfonaidopropyl, and phenylsulfonylmethyl), an aralkyl group (e.g., o-hydroxybenzyl), or an aryl group (e.g., phenyl, 3,5-dichlorophenyl, o-methanesulfonamidophenyl, and 4-methanesulfonylphenyl), and more preferably a hydrogen atom.

Where $G_1$ is a sulfonyl group, $R_{32}$ preferably represents an alkyl group (e.g., methyl), an aralkyl group (e.g., o-hydroxyphenylmethyl), an aryl group (e.g., phenyl), or a substituted amino group (e.g., dimethylamino).

Where $G_1$ is a sulfoxy group, $R_{32}$ preferably represents a cyanobenzyl group or a methylthiobenzyl group.

Where $G_1$ is $$-\overset{\overset{\displaystyle O}{\|}}{\underset{\underset{\displaystyle R_{32}}{|}}{P}}-,$$

$R_{32}$ preferably represents a methoxy group, an ethoxy group, a butoxy group, a phenoxy group, or a phenyl group, and more preferably a phenoxy group.

Where $G_1$ is an N-substituted or unsubstituted iminomethylene group, $R_{32}$ preferably represents a methyl group, an ethyl group, or a substituted or unsubstituted phenyl group.

Groups mentioned above as the substituents of $R_{31}$ are also appropriate substituents for the $R_{32}$ groups.

$G_1$ preferably represents a carbonyl group.

$R_{32}$ may be a group which makes the $G_1$—$R_{32}$ moiety split off from the remainder of formula (III) to induce cyclization producing a cyclic structure containing the —$G_1$—$R_{32}$ moiety. More specifically, this separation is effected by a cleaving agent represented by formula (a):

$$-R_{33}-Z_{31} \qquad \text{(a)}$$

wherein $Z_{31}$ represents a group which nucleophilically attacks $G_1$ to split the $G_1$—$R_{33}$—$Z_{31}$ moiety from the remainder of formula (a); $R_{33}$ represents a group obtained by removing one hydrogen atom from $R_{32}$; and $R_{33}$ and $Z_{31}$ form a cyclic structure together with $G_1$ upon nucleophilic attack of $Z_{31}$ on $G_1$.

More specifically, when the hydrazine compound of formula (III) undergoes a reaction such as oxidation to produce an intermediate represented by formula $R_{31}—N{=}N—G_1—R_{33}—Z_{31}$, $Z_{31}$ easily reacts nucleophilically with $G_1$ to separate $R_{31}—N{=}N$ from $G_1$. The $Z_{31}$ group includes a functional group capable of directly reacting with $G_1$, e.g., OH, SH, $NHR_{34}$ (wherein $R_{34}$ represents a hydrogen atom, an alkyl group, an aryl group, $—COR_{35}$, or $—SO_2R_{35}$, wherein $R_{35}$ represents a hydrogen atom, an alkyl group, an aryl group, a heterocyclic group, etc.), —COOH (these functional groups may be temporarily protected so as to release the functional group upon hydrolysis with an alkali, etc.), or a functional group which becomes capable of reacting with Gon reacting with a nucleophilic agent (e.g., a hydroxide ion and a sulfite ion), such as

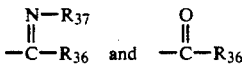

(wherein $R_{36}$ and $R_{37}$ each represents a hydrogen atom, an alkyl group, an alkenyl group, an aryl group, or a heterocyclic group).

The ring formed by $G_1$, $R_{33}$, and $Z_{31}$ is preferably a 5- or 6-membered ring.

Preferred among the groups represented by formula (a) are those represented by either formula (b) or (c):

(b)

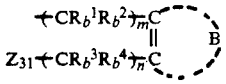

wherein $Z_{31}$ is as defined above; $R_b^1$, $R_b^2$, $R_b^3$, and $R_b^4$, which may be the same or different, each represents a hydrogen atom, an alkyl group (preferably having from 1 to 12 carbon atoms), an alkenyl group (preferably having from 2 to 12 carbon atoms), an aryl group (preferably having from 6 to 12 carbon atoms), etc.; B represents an atomic group necessary to form a substituted or unsubstituted 5- or 6-membered ring; m and n each represents 0 or 1; and (n+m)is 1 or 2.

In formula (b), the 5- or 6-membered ring formed by B includes a cyclohexene, cycloheptene, benzene, naphthalene, pyridine, or quinoline ring.

Formula (c) is shown below:

(c)

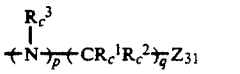

wherein $Z_{31}$ is as defined above; $R_c^1$ and $R_c^2$, which may be the same or different, each represents a hydrogen atom, an alkyl group, an alkenyl group, an aryl group, a halogen atom, etc.; $R_c^3$ represents a hydrogen atom, an alkyl group, an alkenyl group, or an aryl group; p represents 0 or 1; q represents an integer of from 1 to 4; $R_c^1$, $R_c^2$, and $R_c^3$ may be taken together to form a ring provided that $Z_{31}$ is capable of intramolecular nucleophilic attack on $G_1$.

$R_c^1$ and $R_c^2$ each preferably represents a hydrogen atom, a halogen atom, or an alkyl group, and $R_c^3$ preferably represents an alkyl group or an aryl group.

q preferably represents an integer of from 1 to 3. When q is 1, p represents 1; when q is 2, p represents 0 or 1; when q is 3, p represents 0 or 1; and when q is 2 or 3, the $CR_c^1R_c^2$ moieties may be the same or different.

In formula (III), $A_1$ and $A_2$ each represents a hydrogen atom, an alkylsulfonyl or arylsulfonyl group having not more than 20 carbon atoms (preferably a phenylsulfonyl group or a phenylsulfonyl group which is substituted so that the sum of the Hammett's $\sigma$ values is $-0.5$ or more), an acyl group having not more than 20 carbon atoms (preferably a benzoyl group, which is substituted so that the sum of the Hammett substituent group constants ($\sigma$ values) is $-0.5$ or more), or a straight chain, branched or cyclic substituted or unsubstituted aliphatic acyl group (the substituent includes a halogen atom, an ether group, a sulfonamido group, a carbonamido group, a hydroxyl group, a carboxyl group, and a sulfo group)).

$A_1$ and $A_2$ each preferably represents a hydrogen atom.

$R_{31}$ or $R_{32}$ in formula (III) may contain a ballast group commonly employed in immobile photographic additives such as couplers. A ballast group is a group which contains at least 8 carbon atoms and is relatively inert to photographic characteristics. Suitable ballast groups are selected from an alkyl group, an alkoxy group, a phenyl group, an alkylphenyl group, a phenoxy group, an alkylphenoxy group, etc.

$R_{31}$ or $R_{32}$ may further contain a group which accelerates adsorption to silver halide grain. Examples of such an adsorption accelerating group are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, including a thiourea group, a heterocyclic thioamido group, a mercapto heterocyclic group, and a triazole group.

Specific examples of the hydrazine compound represented by formula (III) are shown below, but the present invention is limited to these examples.

(III-1)

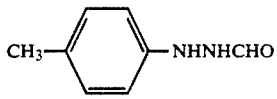

(III-2)

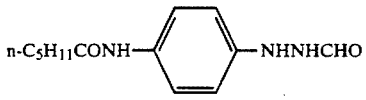

(III-3)

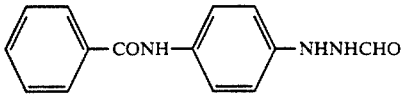

(III-4)

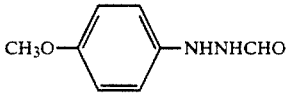

-continued
(III-5)
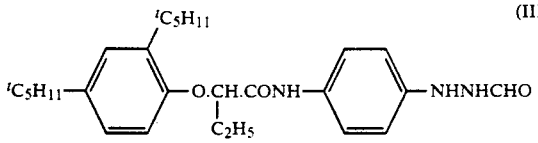
(III-6)
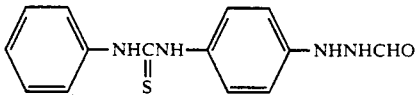
(III-7)
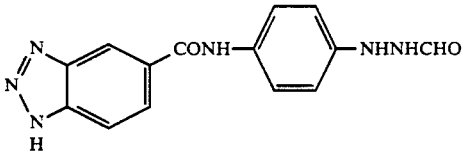
(III-8)
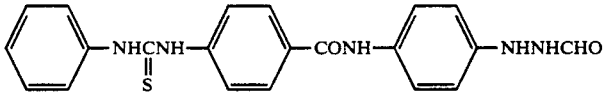
(III-9)
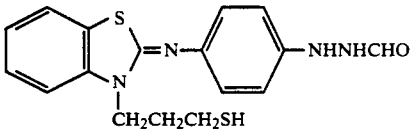
(III-10)
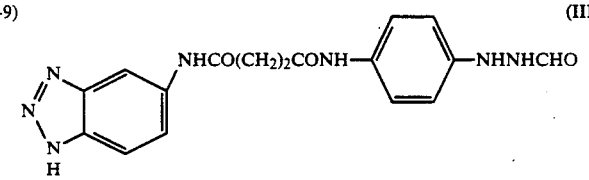
(III-11)
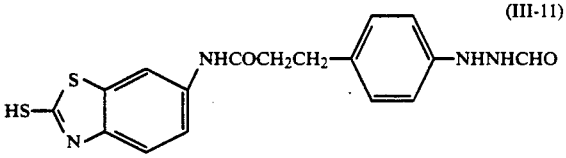
(III-12)
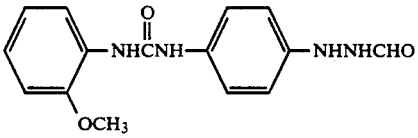
(III-13)
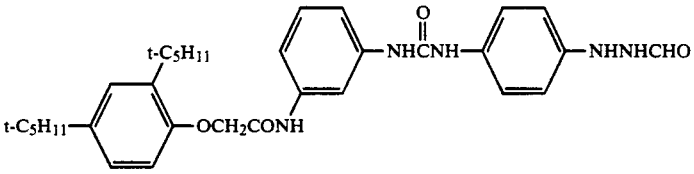
(III-14)
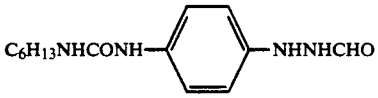
(III-15)
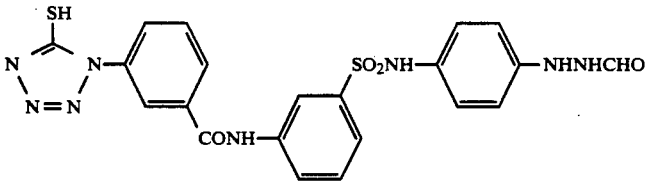
(III-16)
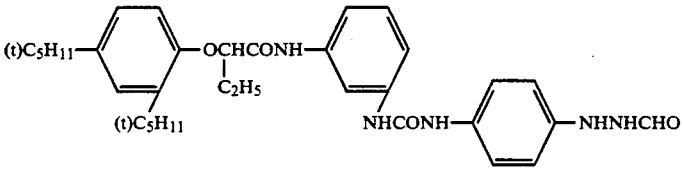
(III-17)
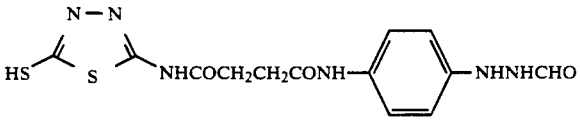

-continued
(III-18)
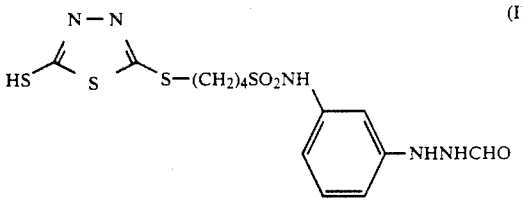
(III-19)
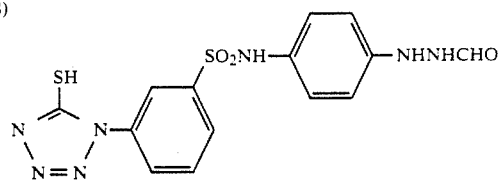
(III-20)
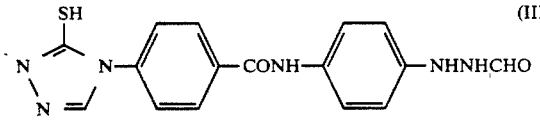
(III-21)
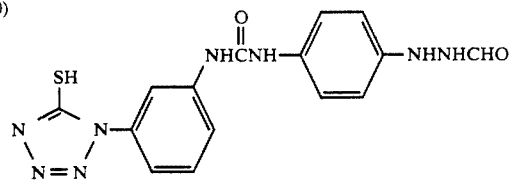
(III-22)
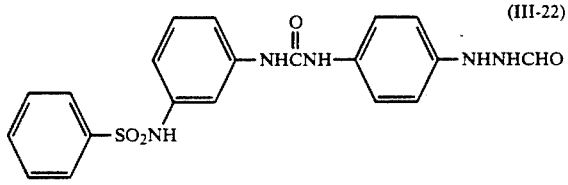
(III-23)
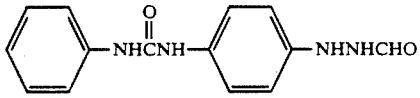
(III-24)
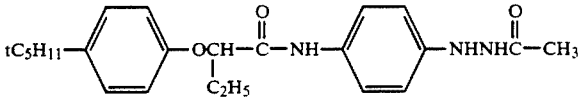
(III-25)
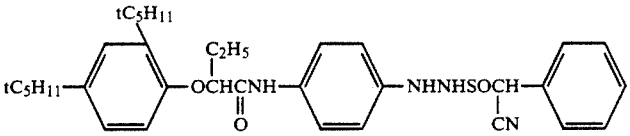
(III-26)
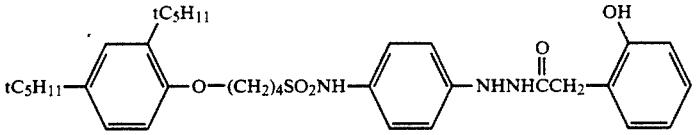
(III-27)
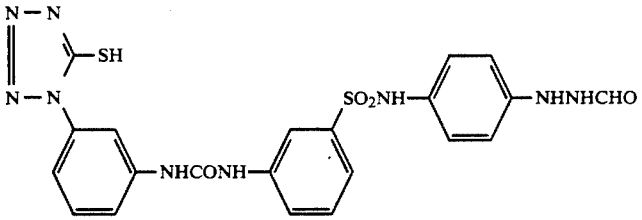
(III-28)
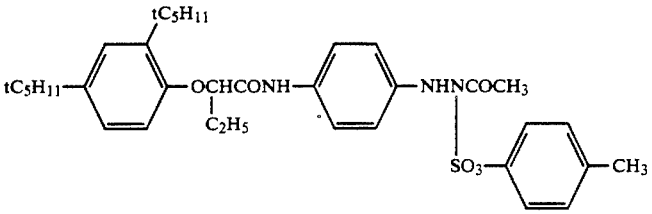
(III-29)
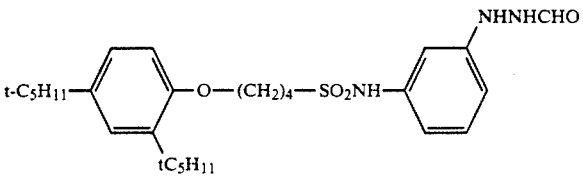

-continued
(III-30)
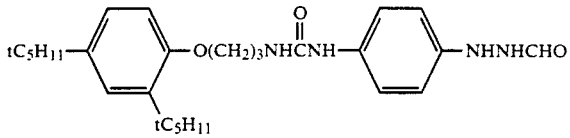
(III-31)
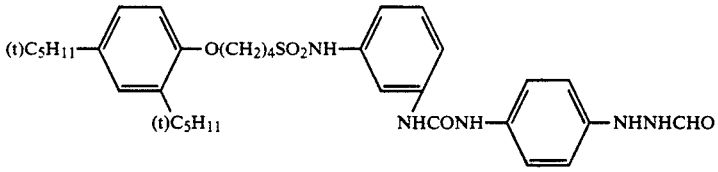
(III-32)
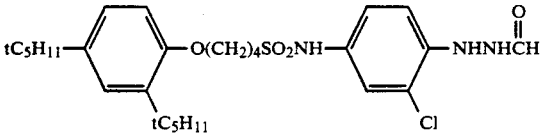
(III-33)
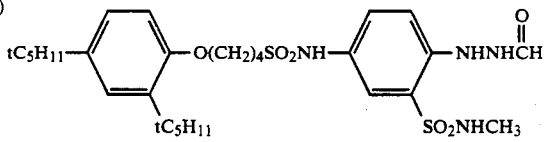
(III-34)
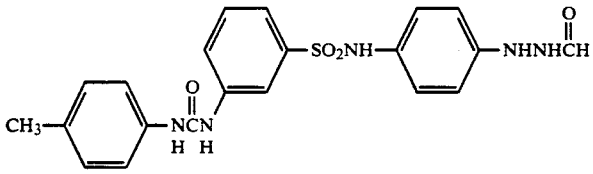
(III-35)
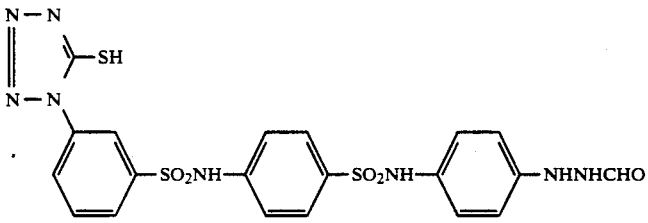
(III-36)
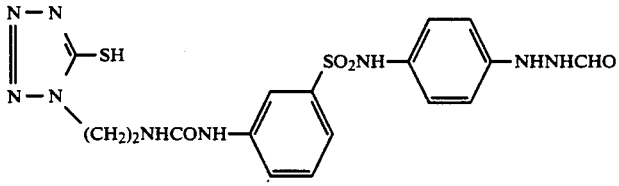
(III-37)
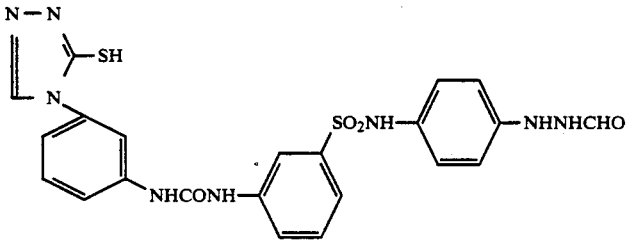
(III-38)
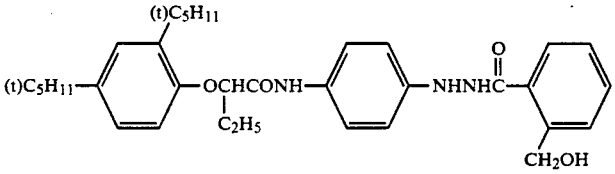

-continued
(III-39)
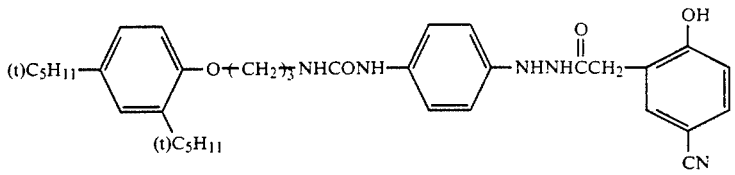
(III-40)
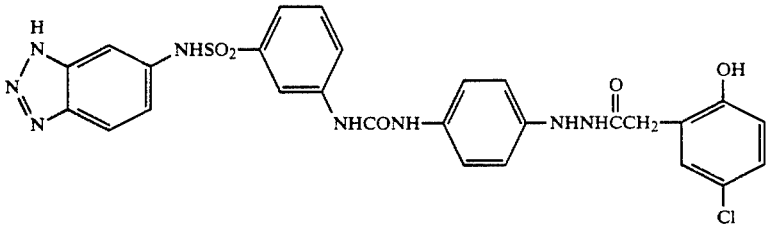
(III-41)
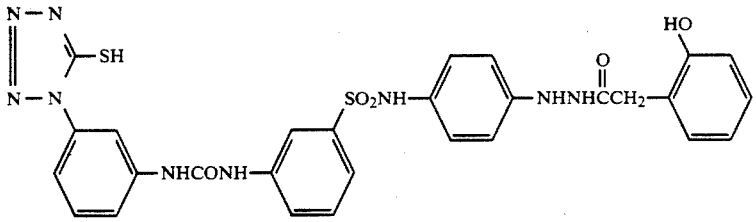
(III-42)
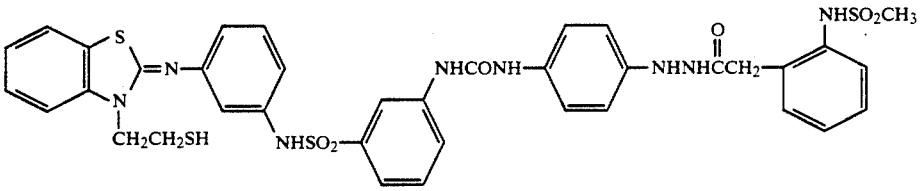
(III-43)
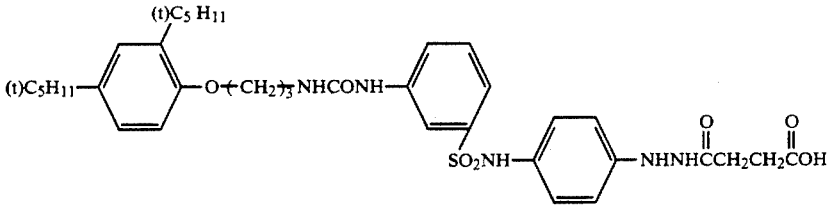
(III-44)
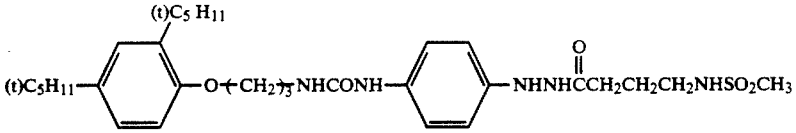
(III-45)
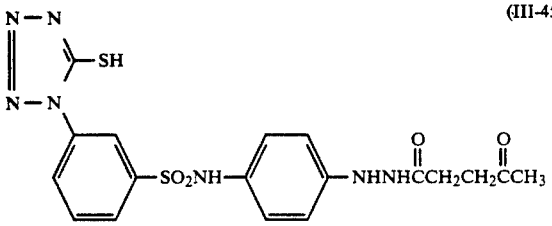
(III-46)
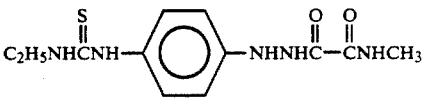
(III-47)
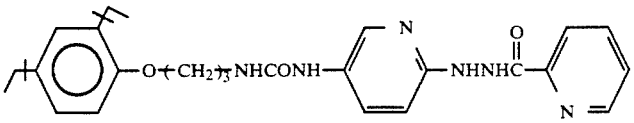

-continued (III-48)

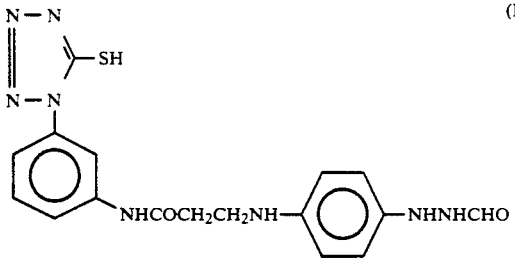

(III-49)

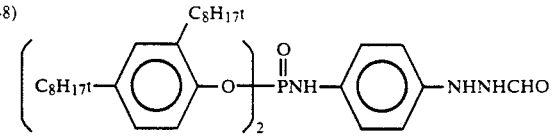

(III-50)

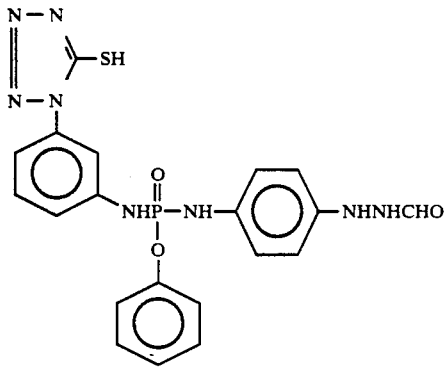

(III-51)

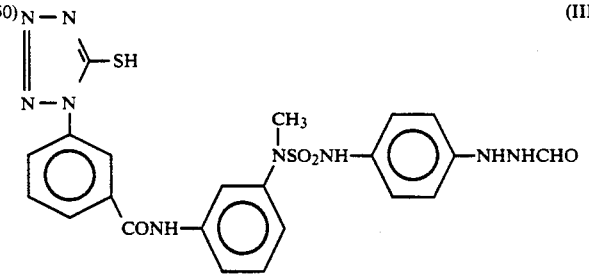

(III-52)

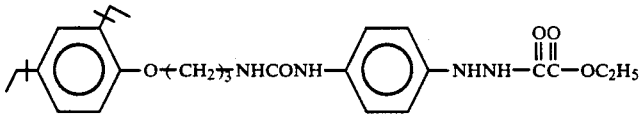

(III-53)

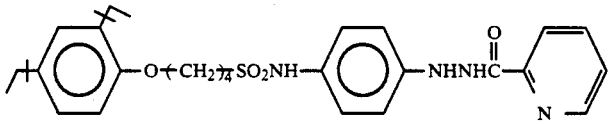

(III-54)

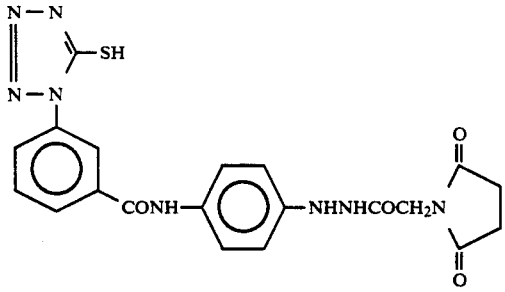

The compound of formula (I) and the hydrazine compound of formula (III) can be incorporated into the same layer or different layers.

In the present invention, the hydrazine compound represented by formula (III) is preferably incorporated into silver halide emulsion layer(s), but can be incorporated into other non-light sensitive hydrophilic colloid layers (e.g., a protecting layer, an intermediate layer, a filter layer, an anti-halation layer, etc.). More specifically, when the hydrazine compound is water-soluble, an aqueous solution of the hydrazine compound or, when the hydrazine compound is difficultly soluble in water, a solution of the hydrazine compound in a water-miscible organic solvent such as alcohols, esters, ketones, etc. can be added to hydrophilic colloid layers. When the solution of hydrazine compound is added to a silver halide emulsion layer, it may be added at any time between the initial stage of chemical ripening and the coating of the emulsion, but it is preferably added to the emulsion after completion of the chemical ripening and prior to the coating. In particular, it is most preferable to add the compound to a coating composition prepared for coating.

It is desirable that the optimum amount of the compound represented by formula (III) to be used is selected depending upon the grain size of the silver halide emulsion, the halogen composition, the method and the degree of chemical sensitization, the relationship between the layer in which the compound is incorporated and the silver halide emulsion layers, the type of antifoggant used. Test methods for selecting the optimum amount of the compound are well known in the art. Generally, the compound of formula (III) can be preferably used in an amount ranging from $1\times10^{-6}$ to $1\times10^{-4}$ mol, more preferably from $1\times10^{-5}$ to $4\times10^{-2}$ mol, per mol of the silver halide.

In addition to the above-described hydrazine compound of formula (III), the compound of formula (I) of the present invention can also be combined with other known hydrazine compounds. Examples of usable hydrazine compounds are described in *Research Disclosure,* Item 23516, p. 346 (Nov., 1983) and references cited therein, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, JP-A-62-948, EP 217,310, JP-A-63-32538, JP-A-63-104047, JP-A-63-121838, JP-A-63-129337, JP-A-63-223744, and JP-A-64-10233, U.S. Pat. No. 4,686,167, JP-A-62-178246, JP-A-63-234244, JP-A-63-234245, JP-A-63-234246, JP-A-63-294552, JP-A-63-306438, JP-A-64-90439, JP-A-01-276128, JP-A-01-283548, JP-A-01-280747, JP-A-01-283549, JP-A-01-285940, and Japanese Patent Application Nos. 63-147339, 63-179760, 63-229163, 1-18377, 1-18378, 1-18379, 1-15755, 1-16814, 1-40792, 1-42615, and 1-42626.

When combined with the hydrazine compound of formula (III) and a negatively working emulsion, the compound of formula (I) provides a negative image of high contrast. On the other hand, the compound of formula (I) of the present invention may be used in combination with an internal latent image type silver halide emulsion. It is preferable to take advantage of a combination of the compound of formula (I) with the hydrazine compound of formula (III) and a negatively working emulsion in obtaining a negative image of high contrast.

When the compound of formula (I) of the present invention is used in the formation of a high contrast negative image, fine silver halide grains having a mean grain size of 0.7 μm or less and particularly 0.5 μm or less are preferably employed. Grain size distribution is not essentially limited, but a mono-dispersion is preferred. The terminology "mono-dispersion" dispersion" means a dispersion in which at least 95% by weight or number of grains fall within a size range of ±40% of a mean grain size.

The silver halide grains which can be used in the practice of the present invention to provide a photographic emulsion may have a regular crystal form, such as an octahedral form, a rhombic dodecahedral form, and a tetradecahedral form; or an irregular crystal form, such as a spherical form and a plate-like form; or a composite form of these crystal forms.

Individual silver halide grains may have a uniform phase therethrough or different phases between the inside and the surface layer thereof.

During silver halide grain formation or physical ripening of the grains, a cadmium salt, a sulfite salt, a lead salt, a thallium salt, a rhodium salt or a complex thereof, an iridium salt or a complex thereof, etc. may be present in the system.

The silver halide emulsion used in the present invention can be any of silver chloride, silver bromide, silver iodobromide and silver iodochlorobromide emulsions.

The silver halide emulsion which can be used in the present invention may or may not be chemically sensitized. Chemical sensitization of silver halide emulsions can be carried out by any of the known techniques, such as sulfur sensitization, reduction sensitization, and noble metal sensitization, either alone or in combination thereof.

Among the noble metal sensitization techniques, typical is gold sensitization using a gold compound, usually a gold complex. Complexes of noble metals other than gold, e.g., platinum, palladium and rhodium, may also be employed. Specific examples of these noble metal compounds are described in U.S. Pat. No. 2,448,060 and British Patent 618,016.

Sulfur sensitization is effected by using a sulfur compound contained in gelatin as well as various sulfur compounds, e.g., thiosulfates, thioureas, thiazoles, and rhodanines.

In the above-described silver halide emulsion preparation, it is preferable to add an iridium salt or a rhodium salt before completion of physical ripening, particularly during grain formation.

To obtain an increased maximum density ($D_{max}$), a silver halide emulsion layer of the light-sensitive material according to the present invention preferably contains two mono-dispersed emulsions differing in mean grain size as taught in JP-A-61-223734 and JP-A-62-90646. In this case, the mono-dispersed grains of smaller size is preferably chemically sensitized, more preferably sulfur sensitized. The mono-dispersed grains of larger size may or may not be chemically sensitized. In general, since the latter grains (larger grains) tend to cause black pepper when chemically sensitized, no chemical sensitization is conducted on the larger grains. In cases where chemical sensitization of the larger grains is carried out, it is preferable to conduct a light chemical sensitization so as not to cause black pepper. Light chemical sensitization can be performed by reducing the time or temperature of chemical sensitization or the amount of chemical sensitizer which is added, as compared with the chemical sensitization of the smaller grains. The difference in sensitivity between the larger size mono-dispersed emulsion and the smaller size mono-dispersed emulsion is not particularly limited, but the difference as expressed in terms of ΔlogE is usually from 0.1 to 1.0, preferably from 0.2 to 0.7. The larger size mono-dispersed emulsion preferably has a higher logE. The terminology "sensitivity" as herein referred to means sensitivity of a sample prepared by coating each emulsion containing the hydrazine compound on a support and processing the coated material with a developer having a pH of from 10.5 to 12.3 and containing at least 0.15 mol/l of a sulfite ion. The grain size of the smaller size mono-dispersed grains is not more than 90%, preferably not more than 80%, of the mean grain size of the larger size mono-dispersed grains. The mean grain size of the silver halide emulsion grains preferably is from 0.02 to 1.0 μm, and more preferably from 0.1 to 0.5 μm, and the mean grain size of each of the larger size grains and the smaller size grains is preferably within this range.

Where two or more emulsions differing in grain size are employed, the smaller size mono-dispersed emulsion is preferably coated to a silver coverage of from 40 to 90% by weight, more preferably from 50 to 80% by weight, based on the total silver coverage.

The mono-dispersed emulsions having different grain sizes may be incorporated into the same layer or separate layers. In the latter case, it is preferable to incorporate the larger size emulsion into an upper layer, and the smaller size emulsion into a lower layer, respectively.

The total silver coverage preferably is from 1 to 8 g per $m^2$.

For the purpose of increasing sensitivity, the light-sensitive material according to the present invention can contain sensitizing dyes, such as cyanine dyes and merocyanine dyes, as described in JP-A-55-52050, pp. 45–53. The sensitizing dyes may be used either individually or in combination of two or more thereof. A combination of sensitizing dyes is frequently used for supersensitization. The emulsion may also contain, in addition to the sensitizing dye, a dye which has no spectral sensitization activity per se but exhibits supersensitization activity or a substance which does not substantially absorb visible light but exhibits supersensitization activity. Examples of useful sensitizing dyes, dyes exhibiting supersensitization, and substances exhibiting supersensitization are described in *Research Disclosure,* Vol. 176, No. 17643, p. 23, IV-J (Dec., 1978).

To prevent fog during preparation, preservation or photographic processing of the light-sensitive material or to stabilize photographic properties, various compounds can be introduced into the light-sensitive material of the present invention. Such compounds include: azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds, such as oxazolinethione; azaindenes, such as triazaindenes, tetraazaindenes (especially 4-hydroxy-substituted (1,3,3a,7)-tetraazaindenes), and pentaazaindenes; benzenethiosulfonic acids, benzenesulfinic acids, benzenesulfonic acid amides, and many other compounds known as antifoggants or stabilizers. Preferred among them are benzotriazoles (e.g., 5-methylbenzotriazole) and nitroindazoles (e.g., 5-nitroindazole). If desired, these compounds may be introduced into processing solutions.

Examples of a development accelerator or a nucleation infectious development accelerator which can be suitably used in the present invention include the compounds disclosed in JP-A-53-77616, JP-A-54-37732, JP-A-53-137133, JP-A-60-140340, and JP-A-60-14959 as well as various compounds containing a nitrogen or sulfur atom.

These accelerators are used usually in an amount of from $1.0\times10^{-3}$ to 0.5 g/ml, and preferably from $5.0\times10^{-3}$ to 0.1 g/m$^2$, although the optimum amount varies depending on the kind of accelerator.

The photographic emulsion layers or other hydrophilic colloidal layers may contain a desensitizer.

An organic desensitizer which can be used in the present invention is specified by its polarographic half wave potential, i.e., an oxidation-reduction potential determined by polarography. That is, it is specified to have a positive sum of a polarographic anode potential and a cathode potential. Determination of the oxidation-reduction potential by polarography is described, e.g., in U.S. Pat. No. 3,501,307. Organic desensitizers containing at least one water-soluble group, e.g., a sulfo group or a carboxyl group, are preferred. The water-soluble group may be in the form of a salt with an organic base, e.g., ammonia, pyridine, triethylamine, piperidine, and morpholine, or an alkali metal, e.g., sodium and potassium.

Preferred as organic desensitizers are those described in JP-A-63-133145, pp. 55–72 (especially the compounds represented by formulae (III) to (V)).

The organic desensitizer is added to silver halide emulsions in an amount usually of from $1.0\times10^{-8}$ to $1.0\times10^{-4}$ mol/m$^2$, and preferably of from $1.0\times10^{-8}$ to $1.0\times10^{-5}$ mol/m$^2$.

The emulsion layers or other hydrophilic colloidal layers may contain a water-soluble dye as a filter dye or for the purpose of preventing irradiation or for other purposes. Filter dyes to be used are dyes for reducing photographic sensitivity, preferably ultraviolet absorbents having a spectral absorption maximum in the intrinsic sensitivity region of silver halide and dyes showing substantial light absorption in the region mainly in the range of from 380 to 600 nm which are used for improving safety against safelight in handling light-sensitive materials for bright room.

These dyes are preferably fixed by a mordant to an emulsion layer or a light-insensitive hydrophilic colloidal layer farther from the support than the silver halide emulsion layer, depending on the purpose.

The ultraviolet absorbent is usually used in an amount of from $1\times10^{-2}$ to 1 g/m$^2$, and preferably from 50 to 500 mg/m$^2$, though the amount varies somewhat depending on the absorbent's molar extinction coefficient.

The ultraviolet absorbent can be incorporated into a coating composition in the form of a solution in an appropriate solvent, e.g., water, an alcohol (e.g., methanol, ethanol and propanol), acetone, methyl cellosolve, or a mixture thereof.

Suitable ultraviolet absorbents which can be used include aryl-substituted benzotriazole compounds, 4-thiazolidone compounds, benzophenone compounds, cinnamic ester compounds, butadiene compounds, benzoxazole compounds, and ultraviolet absorbing polymers. Specific examples of these ultraviolet absorbents are described in U.S. Pat. Nos. 3,533,794, 3,314,794, and 3,352,681, JP-A-46-2784, U.S. Pat. Nos. 3,705,805, 3,707,375, 4,045,229, 3,700,455, and 3,499,762, and West German Patent Publication 1,547,863.

Filter dyes which can be used include oxonol dyes, hemioxonol dyes, styryl dyes, merocyanine dyes, cyanine dyes, and azo dyes. To minimize color remaining after development processing, water-soluble dyes or dyes which are discolored with an alkali or a sulfite ion are preferred.

Specific examples of suitable filter dyes include pyrazolone oxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284, and 3,718,472, enaminohemioxonol dyes described in U.S. Pat. No. 3,976,661, and dyes described in British Patents 584,609 and 1,177,429, JP-A-48-85130, JP-A-49-99620, JP-A-49-114420, and U.S. Pat. Nos. 2,533,472, 3,148,187, 3,177,078, 3,247,127, 3,540,887, 3,575,704, and 3,653,905.

The dyes are added to a coating composition for a light-insensitive hydrophilic colloidal layer in the form of a solution in an appropriate solvent, e.g., water, an alcohol (e.g., methanol, ethanol, and propanol), acetone, methyl cellosolve, or a mixture thereof.

A suitable amount of the dye to be added usually is from $1\times10^{-3}$ to 1 g/m$^2$, and particularly from $1\times10^{-3}$ to 0.5 g/m$^2$.

The photographic emulsion layers or other hydrophilic colloidal layers may contain an organic or inorganic hardening agent, such as chromates, aldehydes (e.g., formaldehyde and glutaraldehyde), N-methylol compounds (e.g., dimethylolurea), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids, either individually or in combination thereof.

The photographic emulsion layers or other hydrophilic colloidal layers may further contain various surface active agents for the purpose of a coating aid, static charge prevention, improvement of slip properties, emulsification and dispersion aid, prevention of blocking, and improvement of photographic characteristics (e.g., acceleration of development, increase of contrast, and increase of sensitivity). Surface active agents which are particularly useful in the present invention are polyalkylene oxides having a molecular weight of 600 or more as disclosed in JP-B-58-9412 (the term "JP-B" as used herein means an "examined published Japanese patent application"). For particular use as an antistatic agent, fluorine-containing surface active agents are preferred. For the details of fluorine-containing surface active agents, reference can be made to U.S. Pat. No. 4,201,586, JP-A-60-80849, and JP-A-59-74554.

For the purpose of preventing blocking, the photographic emulsion layers or other hydrophilic colloidal layers may furthermore contain a matting agent, such as silica, magnesium oxide, and polymethyl methacrylate.

For the purpose of improving dimensional stability and the like, the photographic emulsions can contain a dispersion of a water-insoluble or sparingly water-soluble synthetic polymer. Examples of such a polymer include homopolymers or copolymers of an alkyl (meth)acrylate, an alkoxyalkyl (meth)acrylate, and glycidyl (meth)acrylate and copolymers comprising these monomers and acrylic acid, methacrylic acid, etc.

The silver halide emulsion layers and other layers preferably contain a compound having an acid radical. Examples of suitable acid radical-containing compounds are organic acids,, e.g., salicylic acid, acetic acid, and ascorbic acid; and homopolymers or copolymers comprising an acid monomer, e.g., acrylic acid, maleic acid, and phthalic acid. With respect to these compounds, reference can be made to JP-A-61-23834, JP-A-61-228437, JP-A-62-25745, and JP-A-62-55642. Preferred among them are ascorbic acid as a low-molecular compound and an aqueous latex of a copolymer comprising an acid monomer (e.g., acrylic acid) and a cross-linking monomer having at least two unsaturated groups (e.g., divinylbenzene) as a high-molecular compound.

The silver halide light-sensitive material of the present invention can be processed with a stable developing solution to obtain ultrahigh contrast and high sensitivity. There is no need to use conventional infectious developers or highly alkaline developers having a pH of nearly 13 as described in U.S. Pat. No. 2,419,975.

More specifically, a negative image having sufficiently high contrast can be obtained by processing the silver halide light-sensitive material of the present invention with a developer containing 0.15 mol/l or more of a sulfite ion as a preservative and having a pH between 10.5 and 12.3, particularly between 11.0 and 12.0.

The developing agent which can be used in the developer is not particularly restricted. In view of the ease of obtaining satisfactory dot quality, the developer preferably contains dihydroxybenzenes. A combination of a dihydroxybenzene and a 1-phenyl-3-pyrazolidone or a combination of a dihydroxybenzene and a p-aminophenol is sometimes employed. The developing agent is preferably used in an amount of from 0.05 to 0.8 mol/l. When using a combination of a dihydroxybenzene and a 1-phenyl-3-pyrazolidone or a p-aminophenol, the former is preferably used in an amount of from 0.05 to 0.5 mol/l, and the latter is preferably used in an amount of not more than 0.06 mol/l.

Sulfites which can be used in the developer as a preservative include sodium sulfite, potassium sulfite, lithium sulfite, ammonium sulfite, sodium bisulfite, potassium metabisulfite, and formaldehyde sodium bisulfite. The sulfite is preferably used in a concentration of 0.4 mol/l or higher, and particularly 0.5 mol/l or higher.

The developer may contain the compound disclosed in JP-A-56-24347 as a silver stain inhibitor; the compound disclosed in JP-A-61-267759 as a dissolving aid; and the compound disclosed in JP-A-60-93433 or the compound disclosed in JP-A-62-186259 as a pH buffer.

As stated above, the compound represented by formula (I) can be used in combination with an internal latent image type silver halide emulsion as well as with a negatively working emulsion. When combined with an internal latent image type silver halide emulsion, the compound of formula (I) is preferably introduced into an internal latent image type silver halide emulsion layer. It may also be introduced into a hydrophilic colloidal layer adjacent to the internal latent image type silver halide emulsion layer. Hydrophilic colloidal layers in which the compound of formula (I) can be introduced are not limited in function, provided that the nucleating agent is not inhibited from diffusing to silver halide grains. Possible layers include color material layers, intermediate layers, filter layers, protective layers, and antihalation layers.

The amount of the compound of formula (I) to be used varies depending on characteristics of silver halide emulsions used, the chemical structure of the nucleating agent, and conditions of development and is therefore subject to wide variation. From a practical standpoint, a useful amount is from about 0.005 mg to 500 mg, and preferably from about 0.01 to 100 mg, per mol of silver in an internal latent image type silver halide emulsion. When the compound is incorporated into a hydrophilic colloidal layer adjacent to the emulsion layer, it is used in the same amount as recited above per mol of silver contained in the same area of the internal latent image type emulsion layer. The terminology "internal latent image type silver halide emulsion" as used herein is defined in JP-A-61-170733, p. 10, upper column and British Patent 2,089,057, pp. 18–20.

Reference can be made to European Patent No. 267482, p. 10, line 57 to p. 11, line 36 with respect to cls thrs publeshel preferred internal latent image type emulsions for use in the present invention and in ibid, p. 11, line 37 to p. 1, line 56 with respect to preferred silver halide grains therefor.

The internal latent image type emulsion may be spectrally sensitized to blue light of a relatively longer wavelength, green light, red light or infrared light by using sensitizing dyes. Sensitizing dyes to be used include cyanine dyes, merocyanine dyes, complex cyanine dyes, complex merocyanine dyes, holopolar cyanine dyes, styryl dyes, hemicyanine dyes, oxonol dyes, and hemioxonol dyes. These sensitizing dyes include, for example, cyanine dyes or merocyanine dyes described in JP-A-59-40638, JP-A-59-40636, and JP-A-59-38739.

The light-sensitive material according to the present invention can contain dye image-forming couplers (i.e., cyan, magenta, and yellow couplers) as color materials. It is also possible to develop the light-sensitive material with a developer containing the dye image-forming couplers.

Specific examples of the cyan, magenta and yellow couplers which can be used in this invention are described in *Research Disclosure,* 17643, Item VII-D (Dec., 1978) and ibid, 18717 (Nov., 1979).

In addition, couplers producing dyes having moderate diffusibility, colorless couplers, DIR couplers capable of releasing a developing inhibitor on a coupling reaction, or couplers capable of releasing a developing accelerator on coupling reaction can also be employed.

Yellow couplers which can be used in this invention typically include oil-protected acylacetamide couplers.

It is advantageous to use two-equivalent yellow couplers typically including oxygen-release yellow couplers and nitrogen-release yellow couplers. α-Pivaloylacetanilide couplers are excellent in dye stability, particularly stability to light. On the other hand, α-benzoylacetanilide couplers provide high color densities.

Magenta couplers which can be used in the present invention include oil-protected type indazolone or cyanoacetyl couplers, and preferably 5-pyrazolone couplers and pyrazoloazole couplers, such as pyrazolotriazoles. 5-Pyrazolone couplers having an arylamino group or an acylamino group at the 3-position are preferred in view of hue and density of developed dyes.

Releasable groups of 2-equivalent 5-pyrazolone couplers preferably include nitrogen-release groups described in U.S. Pat. No. 4,310,619 and arylthio groups described in U.S. Pat. No. 4,351,897. 5-Pyrazolone couplers having a ballast group as described in EP 73,636 provide high color densities.

Pyrazoloazole couplers includepyrazolobenzimidazoles described in U.S. Pat. No. 3,379,899, and preferably 3,725,067, pyrazolotetrazoles described in *Research Disclosure,* 24220 (Jun., 1984), and pyrazolopyrazoles described in *Research Disclosure,* 24230 (Jun., 1984). From the standpoint of reduced yellow side absorption and light stability of produced dyes, imidazolo[1,2-b]pyrazoles described in EP 119,741 are preferred. Pyrazolo[1,5-b][1,2,4]triazole described in EP 119,860 is particularly preferred.

Cyan couplers which can be used in the present invention include oil-protected naphthol and phenol couplers. Typical examples of cyan couplers are naphthol couplers described in U.S. Pat. No. 2,474,293, preferably oxygen-release 2-equivalent naphthol couplers described in U.S. Pat. Nos. 4,052,212, 4,146,396, 4,228,233, and 4,296,200. Examples of phenol couplers are described in U.S. Pat. Nos. 2,369,929, 2,801,171, 2,772,162, and 2,895,826. Cyan couplers exhibiting stability to moisture and heat are preferably used in the present invention. Typical examples of such cyan couplers are phenol couplers having an alkyl group of 2 or more carbon atoms at the m-position of the phenolic nucleus as described in U.S. Pat. No. 3,772,002, 2,5-diacylamino-substituted phenol couplers, and phenol couplers having a phenylureido group at the 2-position and an acylamino group at the 5-position.

In order to correct undesired absorption in the shorter wavelength region as possessed by the dyes formed from the magenta and cyan couplers, it is preferable to use colored couplers in color light-sensitive materials for shooting.

Graininess can be improved by using couplers producing dyes having moderate diffusibility. Examples of such couplers are described in U.S. Pat. No. 4,366,237 and British Patent 2,125,570 (magenta couplers]; EP 96,570 and West German Patent Publication 3,234,533 (yellow, magenta or cyan couplers).

Dye-forming couplers and the above-described special couplers may have the form of a polymer, including that of a dimer. Typical examples of polymerized dye-forming couplers are described in U.S. Pat. Nos. 3,451,820 and 4,080,211. Specific examples of polymerized magenta coupler are described in British Patent 2,102,173 and U.S. Pat. No. 4,367,282.

In order to satisfy the characteristics required for light-sensitive materials, two or more of the above-described couplers can be incorporated into the same light-sensitive layer, or the same coupler can be introduced into two or more layers.

The standard amount of color couplers to be used is from 0.001 to 1 mol per mole of light-sensitive silver halide. More preferably, 0.01 to 0.5 mol of a yellow coupler, 0.003 to 0.3 mol of a magenta coupler, and 0.002 to 0.3 mol of a cyan coupler are used per mol of silver halide.

Developing agents, such as hydroxybenzenes (e.g., hydroquinone), aminophenols, and 3-pyrazolidones, may be incorporated into the emulsions or light-sensitive materials.

The photographic emulsion which can be used in the present invention can also be combined with a dye image providing compound (color material) in a color diffusion transfer process which releases a diffusive dye in accordance with development of silver halide to provide a desired transferred image on an image-receiving layer. Several color materials for color diffusion transfer process have been proposed. Preferred among them are color materials which are non-diffusive as they are, but become capable of releasing a diffusive dye when split off during an oxidation-reduction reaction with an oxidation product of a developing agent (or an electron transfer agent) (hereinafter referred to as DRR compound), with those having an N-substituted sulfamoyl group being particularly preferred. Among others, DRR compounds having an o-hydroxyarylsulfamoyl group as described in U.S. Pat. Nos. 4,055,428, 4,053,312, and 4,336,322 and DRR compounds having a redox nucleus as described in JP-A-53-149328 are suitable for combination with a nucleating agent. The combined use of such DRR compounds markedly reduces temperature dependence of processing performance.

After imagewise exposure, processing of the light-sensitive material is preferably carried out by color development with a surface developer having a pH of 11.5 or lower and containing an aromatic primary amine color developing agent, either after or during light fogging or chemical fogging using a nucleating agent, followed by bleaching and fixing thereby to directly form a positive color image. The developer to be used more preferably has a pH between 10.0 and 11.0.

Fogging can be effected by either a light fog method in which the entire area of a light-sensitive layer is subjected to a second exposure or a chemical fog method in which development processing is carried out in the presence of a nucleating agent. Development processing may be conducted in the presence of a nucleating agent and fogging light. Also, a light-sensitive material containing a nucleating agent may be subjected to fogging exposure.

The light fog method is described in European Patent No. 267482, p. 17, line 15 to p. 17, line 46. Useful nucleating agents are described in ibid., p. 17, line 47 to p. 21, line 31. In particular, compounds represented by formulas (N-1) and (N-2) are preferred. Specific examples of these compounds are (N-I-1) to (N-I-10) shown on p. 19 and (N-II-1) to (N-II-12) shown on p. 21 of the above-cited European patent.

Nucleation accelerators which can be used in this invention are described in ibid., p. 21, l. 48 to p. 22, l. 17. In particular, (A-1) to (A-13) on pp. 21–22 are preferred.

Color developers which can be used for development processing of the light-sensitive material of the invention are described in ibid., p. 22, l. 18 to p. 22, l. 29. Preferred examples of the aromatic primary amine color developing agents are p-phenylenediamine compounds, typically including 3-methyl-4-amino-N-ethyl-N-(β-methanesulfonamidoethyl)-aniline, 3-methyl-4-amino-N-ethyl-N-(β-hydroxyethyl)aniline,3-methyl-4-amino-N-ethyl-N-methoxyethylaniline and salts thereof (e.g., sulfate and hydrochloride).

To form a direct positive color image by color diffusion transfer using the light-sensitive material of the invention, black-and-white developers, such as phenidone compounds, are also employable.

Photographic emulsion layers, after color development, are usually subjected to bleaching. Bleaching may be carried out simultaneously with fixing (combined bleaching and fixing), or these two steps may be conducted separately. To speed up processing, bleaching may be followed by bleach-fix, or fixing may be followed by bleach-fix.

A bleaching solution or a bleach-fix solution usually contains an aminopolycarboxylic acid iron complex salt as the bleaching agent. Additives which can be used in the bleaching or bleach-fix solution are described in JP-A-62-215272, pp. 20–30.

Desilvering (bleach-fix or fixing) is followed by washing and/or stabilizing. Water which has been rendered soft is preferably used as washing water or a stabilizing solution. Treatments for rendering water soft can be performed by means of an ion-exchange resin as described in JP-A-62-288838 or by a method using an apparatus for back osmosis. The method described in JP-A-62-288838 supra is particularly preferred.

Additives which can be used in the washing and stabilizing steps include those described in JP-A-62-215272, pp. 30–36.

The rate of replenishment in each processing step is preferably low. It is preferably 0.1 to 50 times, more preferably 3 to 30 times, the amount of the prebath which has been carried over per unit area of a light-sensitive material.

The compounds of the present invention can be used in heat-developable light-sensitive materials which are described in, for example, U.S. Pat. No. 4,463,079, 4,474,867, 4,478,927, 4,507,380, 4,500,626, 4,483,914, JP-A-58-149048, JP-A-58-149047, JP-A-59-152440, JP-A-59-154445, JP-A-59-165054, JP-A-59-180548, JP-A-59-168439, JP-A-59-168439 JP-A-59-174832, JP-A-59-174833, JP-A-59-174834, JP-A-59-174835, JP-A-61-232451, JP-A-62-65038, JP-A-62-253159, JP-A-63-316848, JP-A-64-13546, European Patent Publication Nos. 210,660A2 and 220,746A2.

The heat-developable light-sensitive material basically comprises a support having provided thereon a light-sensitive silver halide, a binder, a dye-providing compound, and a reducing agent (the reducing agent may also function as a dye-providing material), and, if necessary, an organic silver salt and other additives may be incorporated therein.

The heat-developable light-sensitive material may be either a negative image forming material or a positive image forming material. For the positive image forming material, a direct-positive emulsion which includes a system using a nucleating agent and a system using a fogging agent is used as a silver halide emulsion, or a dye-providing compound which releases a positively diffusible dye-image is used.

The transfer of a diffusible dye can be effected by various methods. For example, methods of transfer to a dye-fixing layer using an image-forming solvent, transfer to a dye-fixing layer using a high boiling-point organic solvent, transfer to a dye-fixing layer using a hydrophilic hot solvent, and transfer to a dye-fixing layer containing a dye-receiving polymer by utilizing heat-diffusible or sublimable property of the diffusible dye have been proposed, and any of these methods can be used in the present invention.

The above-described image-forming solvent includes, for example, water which can be pure water as well as water usually used. The solvent may be a mixture of pure water and a low boiling point solvent such as methanol, dimethylformamide, acetone, diisobutyl ketone. Further, the solvent may be a solution containing an image-formation accelerator, an antifoggant, a development-stopping agent, a hydrophilic hot solvent, etc.

The present invention is now illustrated in greater detail by way of Examples, but it should be understood that the present invention is not limited thereto.

EXAMPLE 1

Preparation of Light-Sensitive Emulsion

A silver nitrate aqueous solution and a mixed aqueous solution of potassium iodide and potassium bromide were simultaneously added to a gelatin aqueous solution kept at 50° C. in the presence of $4\times10^{-7}$ mol per mol of silver of iridium (III) chloride and ammonia while maintaining a pAg at 7.8 to prepare a cubic mono-dispersed emulsion having a mean grain size of 0.28 μm and an average silver iodide content of 0.3 mol%. After the emulsion was desalted by a flocculation method, 40 g of inert gelatin per mol of silver was added thereto. 5,5'-Dichloro-9-ethyl-3,3'-bis(3-sulfopropyl)oxacarbocyanine as a sensitizing dye and a solution containing $10^{-3}$ mol of potassium iodide per mol of silver were added to the emulsion while it was maintained at 50° C. After allowing the emulsion to stand for 15 minutes, the temperature was decreased.

Coating of Light-Sensitive Emulsion Layer

The above prepared emulsion was re-melted, and the hydrazine compounds shown below were added thereto at 40° C. in the amounts shown.

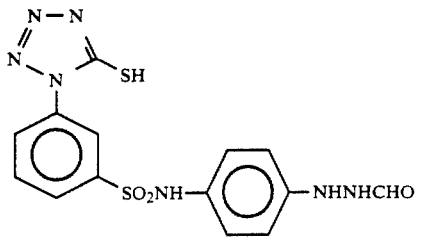

0.6 mg/m²

-continued

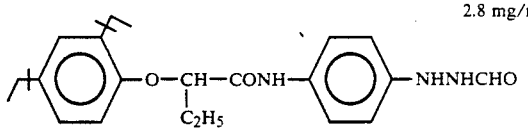

2.8 mg/m²

Further, each of the compounds shown in Table 1 below was added to the emulsion. Moreover, 5-methylbenzotriazole, 4-hydroxy-1,3,3a,7-tetraazaindene, Compounds (i) and (ii) shown below, 30% by weight (based on gelatin) of polyethyl acrylate, and Compound (iii) shown below as a gelatin hardening agent were added thereto. The resulting coating composition was coated on a 150 μm thick polyethylene terephthalate film having a subbing layer comprising a vinylidene chloride copolymer to a silver coverage of 3.8 g/m² and dried to form an emulsion layer.

Compound (i):

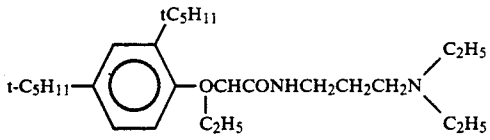

3.5 mg/m²

Compound (ii):

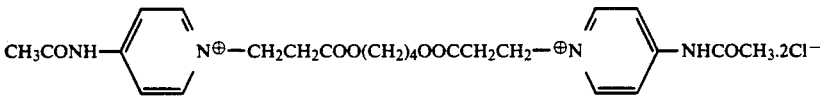

15.0 mg/m²

Compound (iii):

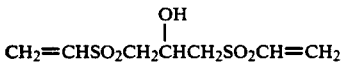

2.0 wt % based on gelatin

Coating of Protective Layer

A composition comprising 1.5 g/m² of gelatin, 0.3 g/m² of polymethyl methacrylate particles (mean particle size: 2.5 μm), and the surface active agents shown below was coated on the emulsion layer and dried to form a protective layer.

Surface Active Agents:

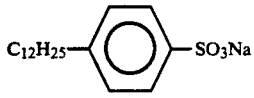

37 mg/m²

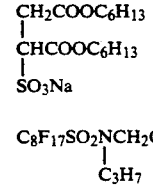

37 mg/m²

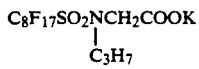

2.5 mg/m²

Evaluation of Performance

Each of the resulting samples was exposed to tungsten light of 3200°K through an optical wedge and a contact screen ("150L Chain Dot Type", produced by Fuji Photo Film Co., Ltd.), developed with a developer having the following formulation at 34° C. for 30 seconds, fixed, washed, and dried.

Dot quality and dot gradation of the processed samples were evaluated, and the results obtained are shown in Table 1.

1) Dot gradation was determined by the equation:

Dot Gradation = Exposure amount providing dot area ratio of 95% $\Delta \log E$ ($\log E95\%$) − Exposure amount providing dot area ratio of 5% ($\log E5\%$)

2) Dot quality was rated according to the following system by visual observation:

5 . . . Best quality
4 . . . Acceptable for practical use
3 . . . Lower limit for practical use
2 . . . Unacceptable for practical use
1 . . . Worst quality

| Developer Formulation: | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water to make | 1 l |
| pH (adjusted with potassium hydroxide) | pH 11.6 |

As is apparent from the results shown in Table 1 below, the samples containing the compound of formula (I) according to the present invention exhibit considerably broadened dot gradation and improved dot quality as compared with the samples containing the comparative compound.

TABLE 1

| Sample No. | Compound Kind | Compound Amount (mol/m²) | Dot Gradation ΔlogE | Dot Quality | Remark |
|---|---|---|---|---|---|
| 1 | — | — | 1.19 | 3 | Comparison |
| 2 | Compound a | $2.0 \times 10^{-5}$ | 1.32 | 4 | " |
| 3 | Compound b | " | 1.23 | 3 | " |
| 4 | Compound c | " | 1.20 | 3 | " |
| 5 | Compound d | " | 1.19 | 3 | " |
| 6 | Compound I-6 | " | 1.42 | 4 | Invention |
| 7 | Compound I-8 | " | 1.45 | 5 | " |
| 8 | Compound I-16 | " | 1.47 | 5 | " |
| 9 | Compound I-17 | " | 1.46 | 4 | " |
| 10 | Compound I-21 | " | 1.45 | 4 | " |
| 11 | Compound I-22 | $3.0 \times 10^{-6}$ | 1.45 | 5 | " |
| 12 | Compound I-24 | " | 1.46 | 5 | " |
| 13 | Compound I-27 | " | 1.43 | 4 | " |
| 14 | Compound I-31 | $2.0 \times 10^{-5}$ | 1.46 | 5 | " |
| 15 | Compound I-36 | " | 1.45 | 5 | " |

Compound (a) (JP-A-61-213847):

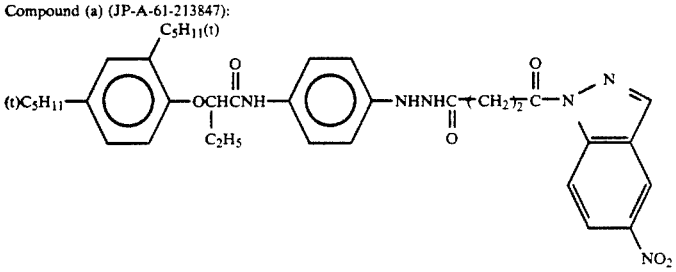

Compound (b) (JP-A-61-213847):

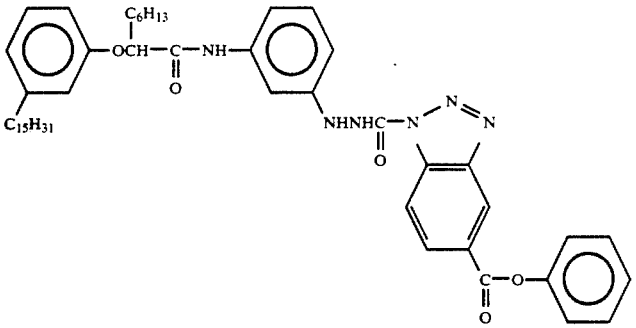

Compound (c) (U.S. Pat. No. 4,684,604):

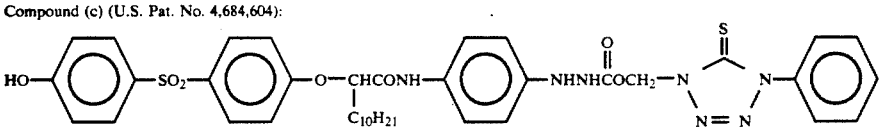

Compound (d) (U.S. Pat. No. 4,684,604):

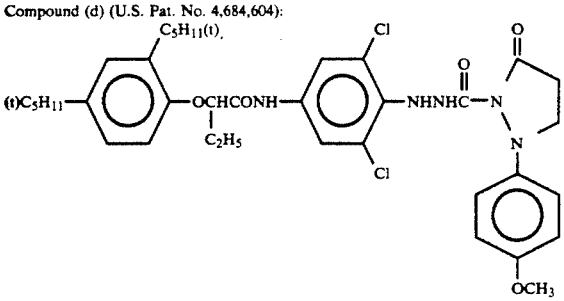

EXAMPLE 2

Each of the samples prepared in Example 1 was exposed to light in the same manner as in Example 1 and developed at 34° C. for 30 seconds under the following condition (A), (B) or (C) by using an automatic developing machine for plate making ("Model FG 660F" produced by Fuji Photo Film Co., Ltd.) filled with the same developer as used in Example 1, followed by fixing, washing, and drying.

Development Condition (A) Development processing was conducted immediately after the temperature of the developer in the automatic developing machine reached 34° C. (development with a fresh developer).

(B) Development processing was conducted after the developer filled in the automatic developing machine was allowed to stand for 4 days (development with an air-fatigued developer).

(C) Commercially available films ("GRADEX GA-100" produced by Fuji Photo Film Co., Ltd.; 50.8 cm×61.0 cm) were exposed to light in such a manner that 50% of the area would be developed and developed by means of the automatic developing machine filled with the developer at a processing rate of 200 films per day for consecutive 5 days. The development of the sample was conducted with the thus fatigued developer (development with a large volume processing-fatigued developer). The developer was supplied at a replenishment rate of 100 cc per film.

Photographic sensitivity of each processed sample was determined to evaluate processing running stability, and the results obtained are shown in Table 2 below. From the standpoint of running stability, it is desirable that the difference in sensitivity between processing condition (A) and (B) or (C) be minimized. As can be seen from the results of Table 2, use of the compound according to the present invention unexpectedly improves processing running stability.

TABLE 2

| Sample No. | Air-Fatigued Developer ($\Delta S_{B-A}$*) | Large Volume Processing-Fatigued Developer ($\Delta S_{C-A}$**) | Remark |
|---|---|---|---|
| 1 | +0.07 | −0.14 | Comparison |
| 2 | +0.04 | −0.08 | " |
| 3 | +0.07 | −0.14 | " |
| 4 | +0.08 | −0.15 | " |
| 5 | +0.07 | −0.15 | " |
| 6 | +0.03 | −0.07 | Invention |
| 7 | +0.03 | −0.07 | " |
| 8 | +0.02 | −0.07 | " |
| 9 | +0.03 | −0.07 | " |
| 10 | +0.02 | −0.06 | " |
| 11 | +0.02 | −0.07 | " |
| 12 | +0.03 | −0.07 | " |
| 13 | +0.03 | −0.06 | " |
| 14 | +0.03 | −0.06 | " |
| 15 | +0.03 | −0.07 | " |

Note:
*$\Delta S_{B-A}$: Difference between sensitivity ($S_A$) when in using a fresh developer and sensitivity ($S_B$) when in using an air-fatigued developer.
**$\Delta S_{C-A}$: Difference between sensitivity ($S_A$) when in using a fresh developer and sensitivity ($S_C$) when in using a large volume processing-fatigued developer.

EXAMPLE 3

A silver nitrate aqueous solution and a sodium chloride aqueous solution were simultaneously added to a gelatin aqueous solution kept at 50° C. in the presence of $5.0\times10^{-6}$ mol per mol of Ag of $(NH_4)_3RhCl_6$. After soluble salts were removed in the usual manner, gelatin was added to the emulsion. Since no chemical ripening was conducted, 2-methyl-4-hydroxy-1,3,3a,7-tetraazaindene was added thereto as a stabilizer. The resulting emulsion was a cubic mono-dispersed emulsion having a mean grain size of 0.15 μm.

To the emulsion was added 49 mg/m² of a hydrazine compound of formula:

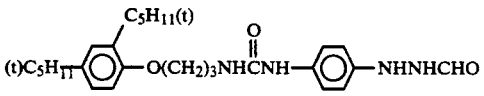

To the emulsion was added each of the compounds shown in Table 3 below. A polyethyl acrylate latex was added in an amount of 30% by weight (on solid basis) based on gelatin, and 1,3-vinylsulfonyl-2-propanol was added as a hardening agent. The resulting coating composition was coated on a polyester support to a silver coverage of 3.8 g/m². The gelatin coverage was 1.8 g/m².

On the thus formed emulsion layer was coated and dried a protective layer having the following composition.

Protective Layer Composition:

| | |
|---|---|
| Gelatin | 1.5 g/m² |
| Matting agent: polymethyl methacrylate particles (average particle size: 2.5 μm) | 0.3 g/m² |
| Surface active agent as coating aid: | |
| 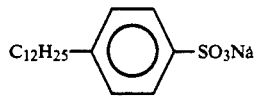 | 37 mg/m² |
| 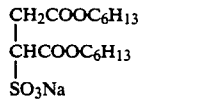 | 37 mg/m² |
| 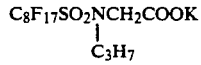 | 2.5 mg/m² |
| Stabilizer: thioctic acid | 2.1 mg/m² |
| Ultraviolet absorbing dye: | 100 mg/m² |
| 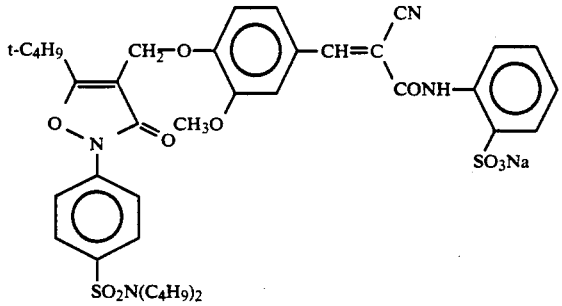 | |

Each of the resulting samples was imagewise exposed to light through an original as illustrated in the FIGURE, developed at 38° C. for 20 seconds, fixed, washed, and dried by means of a bright room printer ("P-607" manufactured by Dai-Nippon Screen K.K.). Image quality of the thus formed white line image was evaluated and rated as follows.

The light-sensitive material for dot-to-dot work was exposed to light at a proper exposure so that a dot area of 50% of the original might form a dot area of 50% on the light-sensitive material. As a result, when a 30 μm wide letter could be reproduced, the image quality was rated 5 (best quality). On the other hand, with the exposure condition being equal, only a 150 μm wide letter could be reproduced, and the image quality was rated 1 (worst quality). Image quality between 5 and 1 was rated 2 to 4 according to visual observation. Quality rated 3 or higher is a level acceptable for practical use.

The results obtained are shown in Table 3. It can be seen that the samples according to the present invention exhibit excellent super-imposed letter quality.

TABLE 3

| Sample No. | Kind | Amount (mol/m²) | Super-imposed Letter Quality | Remark |
|---|---|---|---|---|
| 1 | — | — | 3.0 | Comparison |
| 2 | Compound a | $5.0\times10^{-5}$ | 3.5 | " |

TABLE 3-continued

| Sample No. | Kind | Amount (mol/m$^2$) | Super-imposed Letter Quality | Remark |
|---|---|---|---|---|
| 3 | Compound b | " | 3.0 | " |
| 4 | Compound c | " | 3.0 | " |
| 5 | Compound d | " | 3.0 | " |
| 6 | Compound I-4 | " | 4.5 | Invention |
| 7 | Compound I-8 | " | 4.0 | " |
| 8 | Compound I-16 | " | 5.0 | " |
| 9 | Compound I-22 | $7.0 \times 10^{-6}$ | 4.5 | " |
| 10 | Compound I-23 | " | 4.0 | " |
| 11 | Compound I-24 | " | 5.0 | " |
| 12 | Compound I-28 | " | 4.0 | " |
| 13 | Compound I-30 | " | 4.5 | " |
| 14 | Compound I-31 | $5.0 \times 10^{-5}$ | 4.5 | " |
| 15 | Compound I-36 | $5.0 \times 10^{-5}$ | 5.0 | " |

EXAMPLE 4

Emulsions for photographic layers, a dispersion of zinc hydroxide, a dispersion of active charcoal, a dispersion of an electron-transmitting agent, dispersions of yellow, magenta and cyan couplers and a dispersion for an interlayer were prepared as described below. Then, a photographic material (Sample No. 401) was prepared using these materials as described below. Additionally, an image-receiving material was prepared, also as described below.

Emulsion for Blue-sensitive layer

The following solution (1) and solution (2) were simultaneously added to a well-stirred aqueous gelatin solution (which was prepared by adding 20 g of gelatin, 3 g of potassium bromide, 0.03 g of the following compound (1) and 0.25 g of $HO(CH_2)_2S(CH_2)_2(CH_2)_2OH$ to 800 cc of water and heated at 50° C.), over a period of 30 minutes. Thereafter, the following solution (3) and solution (4) were further added thereto at the same time over a period of 20 minutes. 5 minutes after the initiation of adding the solution (3), a dye solution described below was added over a period of 18 minutes.

After washing with water and desalting, 20 g of lime-processed ossein gelatin was added to the mixture, the pH was adjusted to 6.2, and the pAg to 8.5. Then, sodium thiosulfate, 4-hydroxy-6-methyl-1,3,3a,7-tetraazaindeneandchloroauricacid were added for optimum chemical sensitization to obtain 600 g of a monodispersed cubic silver chlorobromide emulsion having a mean grain size of 0.40 microns.

Solution (1):

-continued

| | |
|---|---|
| $AgNO_3$ (g) | 30 g |
| Water to make | 180 cc |
| Solution (2): | |
| KBr (g) | 17.8 g |
| NaCl (g) | 1.6 g |
| Water to make | 180 cc |
| Solution (3): | |
| $AgNO_3$ (g) | 70 g |
| Water to make | 350 cc |
| Solution (4): | |
| KBr (g) | 49 g |
| Water to make | 350 cc |

Dye Solution

The following dyes were dissolved in 160 cc of methanol.

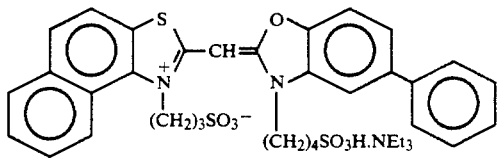

0.18 g

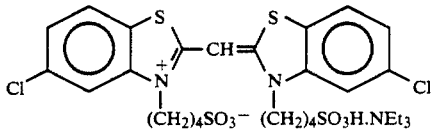

0.06 g

Compound (1):

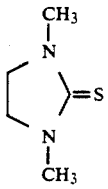

Emulsion for Green-sensitive Layer

The following solutions (I) and (II) were added over a period of 30 minutes to the aqueous gelatin solution shown below which was well stirred and heated at 50° C. Then, the solutions (III) and (IV) were added thereto over a period of 30 minutes, and, thereafter, the dye solution described below was added one minute after the completion of the addition of the solutions (III) and (IV).

| | |
|---|---|
| Gelatin Solution: | |
| Gelatin | 20 g |
| NaCl | 6 g |
| KBr | 0.3 g |
| 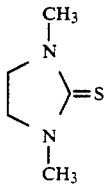 | 0.015 g |
| Water | 730 ml |
| Solution (I): | |

-continued

| | |
|---|---|
| $AgNO_3$ | 50 g |
| Water to make | 200 cc |
| Solution (II): | |
| KBr | 21 g |
| NaCl | 6.9 g |
| Water to make | 200 cc |
| Solution (III): | |
| $AgNO_3$ | 50 g |
| Water to make | 200 cc |
| Solution (IV): | |
| KBr | 28 g |
| NaCl | 3.5 g |
| Water to make | 200 cc |
| Composition of Dye Solution: | |
| 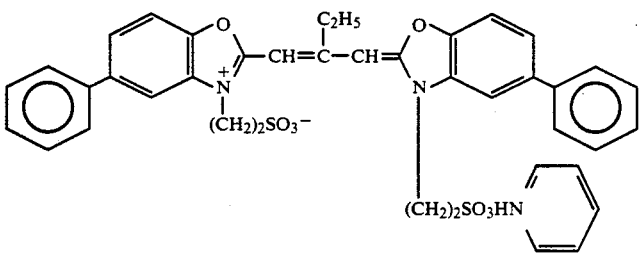 | 0.23 g |
| Methanol | 154 cc |

After washing with water and desalting, 20 g of gelatin was added thereto, the pH and pAg were adjusted, and triethylthiourea, chloroauric acid and 4-hydroxy-6-methyl-1,3,3a,7-tetraazaindene were added for optimum chemical sensitization.

Emulsion for Red-sensitive Layer

The following solutions (I) and (II) were added to a well-stirred aqueous gelatin solution (as prepared by adding 20 g of gelatin, 0.3 g of potassium bromide, 6 g of sodium chloride and 30 mg of the following compound (A) to 800 ml of water and heated at 50° C.) at the same time and at the same flow rate over a period of 30 minutes. Thereafter, the following solutions (III) and (IV) were also added at the same time over a period of 30 minutes. 3 minutes after the initiation of adding the solutions (III) and (IV), the dye solution described below was added over a period of 20 minutes.

After washing with water and desalting, 22 g of lime-processed ossein gelatin was added thereto, the pH was adjusted to 6.2, and the pAg to 7.7. Then, sodium thiosulfate, 4-hydroxy-6-methyl-1,3,3a,7-tetraazaindene and chloroauric acid were added for optimum chemical sensitization at 60° C. to obtain a monodispersed cubic silver chlorobromide emulsion having a mean grain size of 0.38 microns. The yield of the emulsion was 635 g.

| | |
|---|---|
| Solution (I): | |
| $AgNO_3$ (g) | 50.0 g |
| Water to make | 200 ml |
| Solution (II): | |
| KBr | 28.4 g |
| NaCl | 3.4 g |
| Water to make | 200 ml |
| Solution (III): | |
| $AgNO_3$ (g) | 50.0 g |
| Water to make | 200 ml |
| Solution (IV): | |
| KBr | 35.0 g |
| Water to make | 200 ml |
| Compound (A): | |

-continued

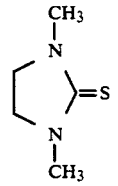

Dye Solution 67 mg of the following dye (a) and 133 mg of the following dye (b) were dissolved in 100 ml of methanol.

Dye (a):

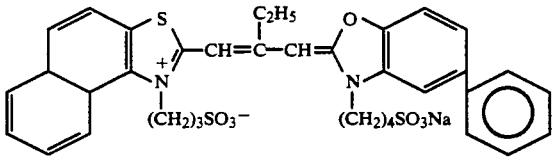

Dye (b):

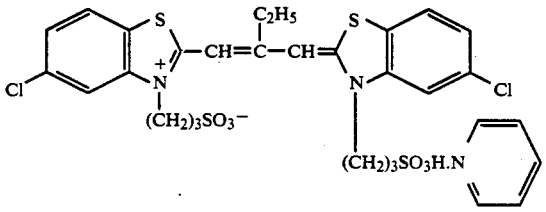

Then, a dispersion of zinc hydroxide was prepared as described below.

12.5 g of zinc hydroxide having a mean grain size of 0.2 microns, 1 g of carboxymethyl cellulose as a dispersing agent, and 0.1 g of sodium polyacrylate were added to 100 cc of 4% aqueous gelatin solution and milled for 30 minutes with glass beads having a mean grain size of 0.75 mm. The glass beads were then removed to obtain a dispersion of zinc hydroxide.

A dispersion of active charcoal was prepared by adding 2.5 g of active charcoal powder (special grade, product by Wako Pure Chemical), 1 g of Demole N (product by Kao Soap Co.) as a dispersing agent, and 0.25 g of polyethylene glycol nonylphenylether to 100 cc of 5% aqueous gelatin solution, and then milling for 120 minutes with glass beads having a mean grain size of 0.75 mm. After removal of the glass beads, a dispersion of active charcoal having a mean grain size of 0.5 microns was obtained.

A dispersion of an electron-transmitting agent was prepared by adding 10 g of an electron-transmitting agent described below, 0.5 g of polyethylene glycol as a dispersing agent, and 0.5 g of an anionic surfactant described below to a 5% aqueous gelatin solution, and then milling for 60 minutes with glass beads having a mean grain size of 0.75 mm. After removal of the glass beads, a dispersion of an electron-transmitting agent having a mean grain size of 0.3 micron was obtained.

Electron-transmitting Agent:

-continued

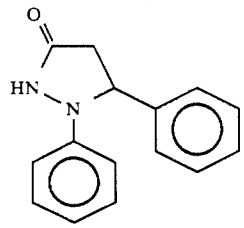

Anionic Surfactant:

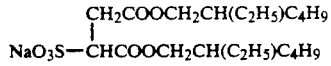

Gelatin dispersions each containing a dye-providing compound were prepared as described below.

An yellow, magenta or cyan dye-providing composition as indicated below was added to 50 cc of ethyl acetate and dissolved while heating at about 60° C. to form a uniform solution. The resulting solution was blended with 100 g of 10% lime-processed gelatin-containing aqueous solution, 0.6 g of sodium dodecylbenzenesulfonate and 50 cc of water by stirring and then dispersed for 10 minutes with a homogenizer at 10000 rpm. The dispersion thus prepared was designated as a gelatin dispersion of a dye-providing compound.

| | Yellow | Magenta | Cyan |
|---|---|---|---|
| Dye-providing Compound (1) | 13 g | — | — |
| Dye-providing Compound (2) | — | 15.5 g | — |
| Dye-providing Compound (3) | — | — | 16.6 g |
| Electron-donating Compound | 10.2 g | 8.6 g | 8.1 g |
| High Boiling Point Solvent | 6.5 g | 7.8 g | 8.3 g |
| Electron-transmitting Agent Precursor Compound (A) | 0.4 g | 0.7 g | 0.7 g |

Dye-providing Compound (1):

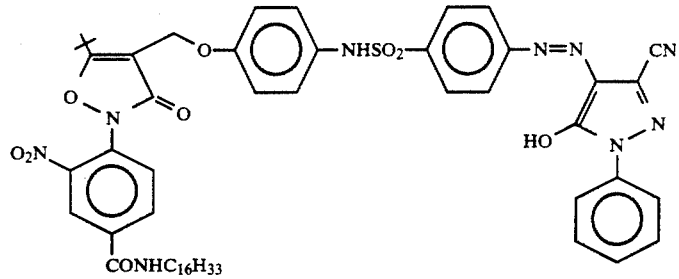

Dye-providing Compound (2):

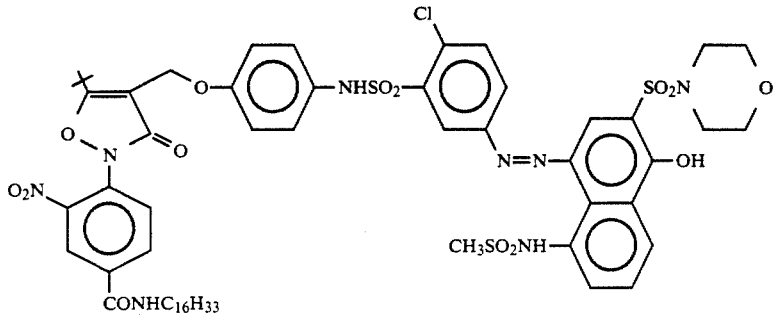

Dye-providing Compound (3):

-continued

| | Yellow | Magenta | Cyan |
|---|---|---|---|

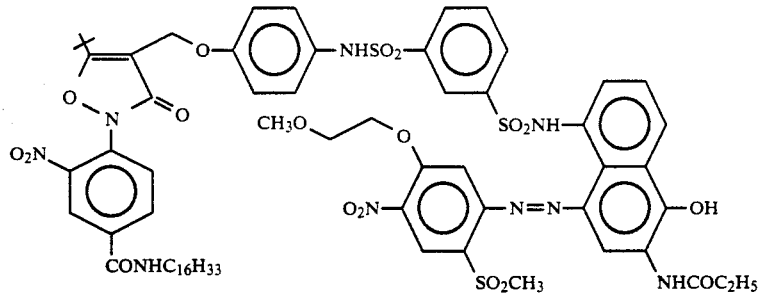

Electron-donating Compound (1):

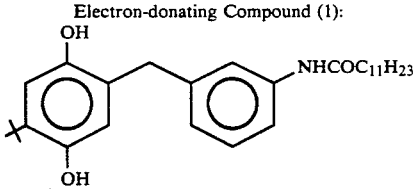

High Boiling Point Solvent (2):

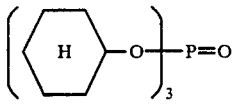

Electron-transmitting Agent Precursor (3):

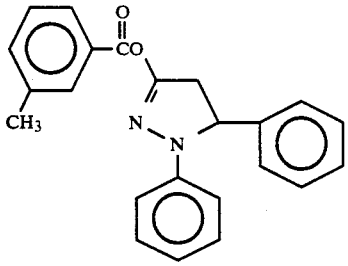

Compound A:

$CO_2C_{12}H_{25}$
|
$CO_2C_{12}H_{25}$

A gelatin dispersion of electron-donating compound (4) for an interlayer was prepared as described below.

23.6 g of the following electron-donating compound (4) and 8.5 g of the above-described high boiling point solvent (2) were added to 30 cc of ethyl acetate to form a uniform solution. The solution was blended with 100 g of 10% aqueous solution of lime-processed gelatin, 0.25 g of sodium hydrogen sulfite, 0.5 g of sodium dodecylbenzenesulfonate and 30 cc of water with stirring, and then dispersed for 10 minutes with a homogenizer at 10000 rpm. The resulting dispersion was designated as a gelatin dispersion of electron-donating compound (4).

Electron-donating Compound (4):

-continued

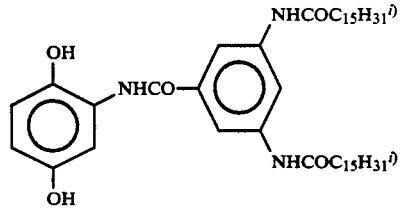

Constitution of Sample No. 1 was as follows:

| | Coated Amount ($mg/m^2$) |
|---|---|
| Sixth Layer: Protective Layer | |
| Gelatin | 900 |
| Silica (size, 4 microns) | 40 |
| Zinc Hydroxide | 900 |
| Surfactant (5)*1 | 130 |
| Surfactant (6)*2 | 26 |
| Polyvinyl Alcohol | 63 |
| Lactose | 153 |
| Water-soluble Polymer*3 | 8 |
| Fifth Layer: Blue-sensitive Emulsion Layer | |
| Light-sensitive Silver Halide Emulsion | 380 as Ag |

-continued

| | |
|---|---|
| Antifoggant (7)*4 | 0.9 |
| Gelatin | 560 |
| Yellow Dye-providing Compound (1) | 400 |
| Electron-donating Compound (1) | 320 |
| Electron-transmitting Agent Precursor (3) | 25 |
| Compound (A) | 120 |
| High Boiling Point Solvent (2) | 200 |
| Surfactant (8)*5 | 45 |
| Water-soluble Polymer*3 | 13 |
| Fourth Layer: Interlayer | |
| Gelatin | 355 |
| Electron-donating Compound (4) | 130 |
| High Boiling Point Solvent (2) | 48 |
| Electron-transmitting Agent (10)*7 | 85 |
| Surfactant (6)*2 | 15 |
| Surfactant (8)*5 | 4 |
| Surfactant (9)*6 | 30 |
| Polyvinyl Alcohol | 30 |
| Lactose | 155 |
| Water-soluble Polymer*3 | 19 |
| Hardening Agent (11)*8 | 37 |
| Third Layer: Green-sensitive Emulsion Layer | |
| Light-sensitive Silver Halide Emulsion | 220 as Ag |
| Antifoggant (12)*9 | 0.7 |
| Gelatin | 370 |
| Magenta Dye-providing Compound (2) | 350 |
| Electron-donating Compound (1) | 195 |
| Electron-transmitting Agent Precursor (3) | 33 |
| High Boiling Point Solvent (2) | 175 |
| Surfactant (8)*5 | 47 |
| Water-soluble Polymer*3 | 11 |
| Second Layer: Interlayer | |
| Gelatin | 650 |
| Zinc Hydroxide | 300 |
| Electron-donating Compound (4) | 130 |
| High Boling Point Solvent (2) | 50 |
| Surfactant (6)*2 | 11 |
| Surfactant (8)*5 | 4 |
| Surfactant (9)*6 | 50 |
| Polyvinyl Alcohol | 50 |
| Lactose | 155 |
| Water-soluble Polymer*3 | 12 |
| Active Charcoal | 25 |
| First layer: Red-sensitive Emulsion Layer | |
| Light-sensitive Silver Halide Emulsion | 230 as Ag |
| Antifoggant (12)*9 | 0.7 |
| Gelatin | 330 |
| Cyan Dye-providing Compound (3) | 340 |
| Electron-donating Compound (1) | 133 |
| Electron-transmitting Agent Precursor (3) | 30 |
| High Boiling Point Solvent (2) | 170 |
| Surfactant (8)*5 | 40 |
| Water-soluble Polymer*3 | 5 |
| Support: | |
| Polyethylene Terephthalate (96 microns thick) (Carbon black was added to the backing layer.) | |

Compounds used above are as follows:

*1Surfactant (5):

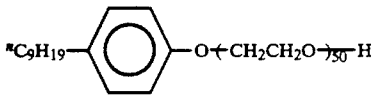

*2Surfactant (6):

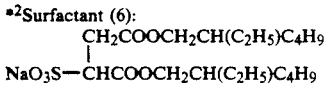

*3Water-soluble Polymer:

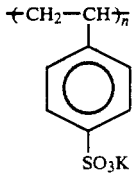

*4Antifoggant (7):

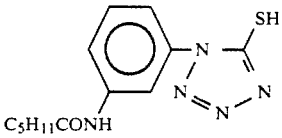

*5Surfactant (8):

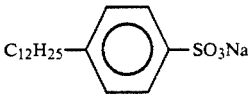

*6Surfactant (9):

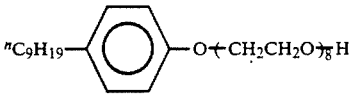

*7Electron-transmitting Agent (10):

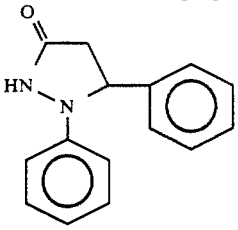

*8Hardening Agent (11):
1,2-Bis(vinylsulfonylacetamide)

*9Antifoggant (12):

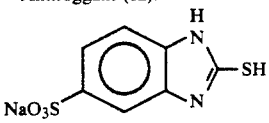

Composition of image-receiving material used herein was as follows:

| | Coated Amount (g/m$^2$) |
|---|---|
| Third Layer: | |
| Gelatin | 0.05 |
| Silicone Oil (1) | 0.04 |
| Surfactant (1) | 0.001 |
| Surfactant (2) | 0.02 |
| Surfactant (3) | 0.10 |
| Matting Agent (1) (silica) | 0.02 |
| Guanidine Picolinate | 0.45 |
| Water-soluble Polymer (1) | 0.24 |
| Second Layer: | |
| Mordant Agent (1) | 2.35 |
| Water-soluble Polymer (1) | 0.20 |
| Gelatin | 1.40 |
| Water-soluble Polymer (2) | 0.60 |
| High Boiling Point Solvent (1) | 1.40 |
| Guanidine Picolinate | 2.25 |
| Brightening Agent (1) | 0.05 |
| Surfactant (5) | 0.15 |
| First Layer: | |
| Gelatin | 0.45 |
| Surfactant (3) | 0.01 |
| Water-soluble Polymer (1) | 0.04 |
| Hardening Agent (1) | 0.30 |
| Support: | |
| The constitution of the support is described below. | |
| First Backing Layer: | |
| Gelatin | 3.25 |
| Hardening Agent (1) | 0.25 |
| Second Backing Layer: | |

-continued

| | Coated Amount (g/m²) |
|---|---|
| Gelatin | 0.44 |
| Silicone Oil (1) | 0.08 |
| Surfactant (4) | 0.04 |
| Surfactant (5) | 0.01 |
| Matting Agent (2) (Benzoguanamine Resin having a mean grain size of 15 microns) | 0.02 |

The constitution of Support was as follows:

| | |
|---|---|
| Surface Subbing layer: | |
| Gelatin | 0.1 micron (thickness) |
| Surface PE Layer (glossy): | |
| Low-density Polyethylene | 45.0 microns (thickness) |
| (density: 0.923) | 89.2 parts |
| Surface-treated Titanium Oxide | 10.0 parts |
| Ultramarine | 0.8 part |
| Pulp Layer: | |
| High-quality Paper LBKP/NBKP = 1/1, density: 1.080) | 92.6 microns (thickness) |
| Back Surface PE Layer (mat): | |
| High-density (density: 0.960) | 36.0 microns (thickness) |
| Back Surface Subbing Layer: | |
| Gelatin | 0.05 micron (thickness) |
| Colloidal Silica | 0.05 micron (thickness) |
| Total | 173.8 microns (thickness) |

Compounds used above are as follows:

Silicone Oil (1):

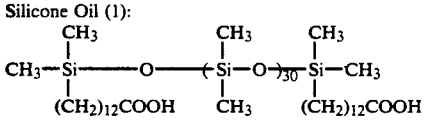

Surfactant (1):

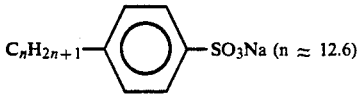

Surfactant (2):

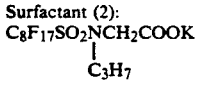

Surfactant (3)

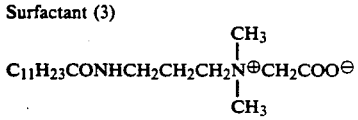

Surfactant (4):

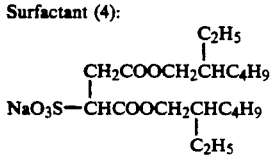

Brightening Agent (1):

2,5-Bis(5-tert-butylbenzoxazolyl(2))thiophene

Surfactant (5):

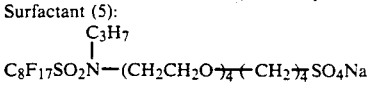

Water-soluble Polymer (1):

Sumicagel L 5-H (product of Sumitomo Chemical Co., Ltd.)

Water-soluble Polymer (2):

Dextran (molecular weight: 70,000)

Mordant Agent (1):

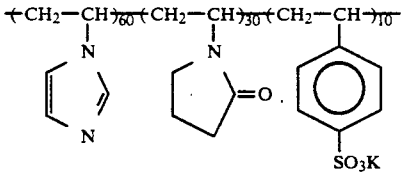

High Boiling Point Solvent (1):

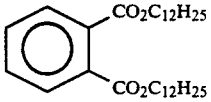

Hardening Agent (1):

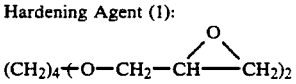

In the same manner as the preparation of Sample No. 401, other Sample Nos. 402 to 406 were prepared, as indicated in Table 4 below. Sample Nos. 402 to 406 each contained a compound of the present invention, which had been dispersed in gelatin by an oil dispersion method, in the second and fourth layers each in an amount of $3\times10^{-3}$ mol/m².

The sample Nos. 401 to 406 thus prepared were exposed by using a spectrophotometric camera through an optical wedge where the optical density continuously varied in the direction vertical to the wavelength.

The exposed samples were then wetted with water by applying a hot water (35° C.) to the emulsion surface of each sample in an amount of 15 ml/m² for 3 seconds. The thus wetted sample was attached to the previously prepared image-receiving material so that the coated surfaces of the two faced to each other.

The combined sample was then heated with a heat roller for 15 seconds whereupon the temperature of the wetted layer was adjusted to be 78° C. Then, the image receiving material was peeled off from the photographic material and, as a result, a blue-green-red spectrographic image was formed on the image-receiving layer in accordance with the wavelength of the light as exposed.

The density of each of the yellow, magenta and cyan colors was measured with 310 Type Densitometer (manufactured by X-rite Co.). The results obtained are shown in Table 4 below.

TABLE 4

| | Sample No. | | | | | |
|---|---|---|---|---|---|---|
| | 401 (Comparison) | 402 (Invention) | 403 (Invention) | 404 (Invention) | 405 (Invention) | 406 (Invention) |
| Compound Added to 2nd and 4th Layers | — | I-8 | I-20 | I-21 | I-34 | I-36 |
| Blue-exposed Region | | | | | | |
| Yellow | 0.80 | 0.65 | 0.60 | 0.60 | 0.65 | 0.70 |
| Magenta | 2.00 | 2.10 | 2.05 | 2.05 | 2.15 | 2.05 |
| Cyan | 2.05 | 2.15 | 2.05 | 2.10 | 2.10 | 2.00 |
| Green-exposed Region | | | | | | |

TABLE 4-continued

| | Sample No. | | | | | |
|---|---|---|---|---|---|---|
| | 401 (Comparison) | 402 (Invention) | 403 (Invention) | 404 (Invention) | 405 (Invention) | 406 (Invention) |
| Yellow | 1.95 | 2.10 | 2.05 | 2.05 | 2.10 | 2.15 |
| Magenta | 0.75 | 0.60 | 0.65 | 0.60 | 0.55 | 0.60 |
| Cyan | 2.00 | 2.10 | 2.15 | 2.05 | 2.05 | 2.10 |
| Red-exposed Region | | | | | | |
| Yellow | 1.95 | 2.10 | 2.00 | 1.95 | 1.95 | 2.00 |
| Magenta | 1.95 | 2.00 | 2.05 | 2.00 | 2.00 | 2.05 |
| Cyan | 0.40 | 0.35 | 0.35 | 0.35 | 0.30 | 0.35 |

From the results above, it is noted that the density of all the blue, green and red colors increased by adding the compound of the present invention. Additionally, the color purity also increased by adding the compound of the present invention due to the decrease in complementary components. Accordingly, it was proved that the compounds of the present invention had an excellent ability to improve the color reproducibility.

Then, the above-described photographic material samples were stored for one month under the condition of 30° C. and 70% RH and thereafter subjected to the same treatment. After the treatment, the same results as those in Table 4 were obtained. Accordingly, it was confirmed that the compounds of the present invention did not adversely affect the storability of the photographic materials containing the compound.

EXAMPLE 5

15 mg of Compound I-9 of the present invention was added to each of the 3rd, 4th, 5th, 7th, 8th, 9th, 11th, 12th and 13th layers of Sample 101 as described in Example 1 of JP-A-01-267638 to prepare Sample 5-1. The resulting sample was then treated and evaluated in the same manner as described in the same example as above and found to be excellent in sharpness and color reproducibility.

EXAMPLE 6

20 mg of Compound I-28 of the present invention was added to each of the 4th, 5th, 6th, 9th, 10th, 11th, 14th, 15th and 16th layers of Sample No. 208 as described in Example 2 of JP-A-01-291250 to prepare Sample No. 6-1. The resulting sample was developed in the same manner as described in the same example as above and found to be excellent in sharpness, graininess and color reproducibility.

EXAMPLE 7

Compound I-1 of the present invention was added to each of the 3rd, 4th, 6th, 7th, 11th and 12th layers of Sample No. 502 as described in Example 4 of European Patent No. 327066A in an amount of 3 mg/m$^2$ per layer to prepare Sample No. 7-1. The resulting sample was developed in the same manner as described in the same example as above and found to be excellent in color reproducibility.

EXAMPLE 8

Compound I-1 of the present invention was added to the emulsion layer of Sample No. 1 as described in Example 1 of JP-A-01-234840 in an amount of 560 mg per 1 mol of silver halide to prepare Sample No. 8-1. The resulting sample was developed in the same manner as described in the same example as above and found to be excellent in blackened density and image quality.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a compound represented by the formula (I):

$$R-NHNH-\underset{\underset{O}{\|}}{C}\left(Time\right)_n Z \qquad (I)$$

wherein R represents an aliphatic group, an aromatic group, or a heterocyclic group, which may be substituted by a group which accelerates adsorption onto silver halide or by a ballast group; Z represents a development inhibitor group containing an anionic functional group which is a member selected from the group consisting of a carboxyl group, a sulfo group, a sulfamoyl group, or a salt thereof as a partial structure; "Time" represents a divalent group which contains a hetero atom and which connects to the carbonyl group through the hetero atom; and n is 0 or 1.

2. A silver halide photographic material as in claim 1, wherein the material also contains a hydrazine compound represented by the general formula (III):

$$R_{31}-\underset{\underset{A_1}{|}}{N}-\underset{\underset{A_2}{|}}{N}-G_1-R_{32} \qquad (III)$$

wherein $R_{31}$ an aliphatic group or an aromatic group; $R_{32}$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, a $$-\overset{\overset{O}{\|}}{\underset{\underset{R_{32}}{|}}{P}}-$$

group or an iminoethylene group, and $A_1$ and $A_2$ represent hydrogen atoms, or one of $A_1$ and $A_2$ represents a hydrogen atom and the other represents a substituted or unsubstituted alkylsulfonyl group, a substituted or unsubstituted arylsulfonyl group or a substituted or unsubstituted acyl group.

3. A silver halide photographic material as in claim 2, wherein $R_{31}$ represents an aryl group.

4. A silver halide photographic material as in claim 2, wherein $A_1$ and $A_2$ represent hydrogen atoms.

5. A silver halide photographic material as in claim 2, wherein $G_1$ represents a carbonyl group.

6. A silver halide photographic material as in claim 2, wherein the compound of general formula (III) contains a ballast group.

7. A silver halide photographic material as in claim 2, wherein the compound of general formula (III) contains a group which promotes adsorption of that compound onto a silver halide.

8. A silver halide photographic material as in claim 2, wherein the photographic material also contains a negatively working emulsion.

9. A silver halide photographic material as in claim 2, wherein the compound represented by formula (I) is contained in an internal latent image type silver halide emulsion layer or in a hydrophilic colloidal layer adjacent to an internal latent image type silver halide emulsion layer.

10. A silver halide photographic material as in claim 1, wherein R represents an aromatic group.

11. A silver halide photographic material as in claim 1, wherein the group represented by R contains a group which accelerates adsorption onto silver halide.

12. A silver halide photographic material as in claim 1, wherein the group represented by R contains a ballast group.

13. A silver halide photographic material as in claim 1, which contains at least one hydrophilic colloid layer, wherein at least one hydrophilic colloid layer is a silver halide photographic emulsion layer, and at least one hydrophilic colloid layer contains said compound represented by formula (I).

14. A silver halide photographic material as in claim 1, wherein said anionic functional group is a sulfo group or a carboxyl group.

* * * * *